US010174532B2

(12) United States Patent
Couturier

(10) Patent No.: US 10,174,532 B2
(45) Date of Patent: Jan. 8, 2019

(54) DOOR SECURITY SYSTEM AND METHOD OF USING SAME

(71) Applicant: Robert J. Couturier, Williamston, MI (US)

(72) Inventor: Robert J. Couturier, Williamston, MI (US)

( * ) Notice: Subject to any disclaimer, the term of this patent is extended or adjusted under 35 U.S.C. 154(b) by 736 days.

(21) Appl. No.: 14/253,268

(22) Filed: Apr. 15, 2014

(65) Prior Publication Data

US 2014/0306466 A1 Oct. 16, 2014

Related U.S. Application Data

(60) Provisional application No. 61/812,410, filed on Apr. 16, 2013.

(51) Int. Cl.
*E05C 19/18* (2006.01)

(52) U.S. Cl.
CPC ..... *E05C 19/184* (2013.01); *Y10T 292/65* (2015.04)

(58) Field of Classification Search
CPC . Y10T 292/34; Y10T 292/37; Y10T 292/373; Y10T 292/379; Y10T 292/388; Y10T 292/391; Y10T 292/394; Y10T 292/397; Y10T 292/65; Y10T 292/67; Y10S 292/15; Y10S 292/65; E05C 19/18; E05C 19/184; E05C 19/188; E05C 17/02; E05C 17/44; E05C 17/446; E05C 17/46; E05C 17/48; E05C 17/54; E05F 5/02
USPC ..... 16/82, 83; 248/351
See application file for complete search history.

(56) References Cited

U.S. PATENT DOCUMENTS 4,178,026 A * 12/1979 Sinkhorn ..... E05C 19/18 292/288
5,398,982 A * 3/1995 Watson, Jr. ..... E05C 19/18 292/259 R
5,454,610 A * 10/1995 Taylor ..... E05C 17/54 292/339
5,490,304 A * 2/1996 Winner, Jr. ..... E05F 5/06 292/DIG. 15
5,531,490 A * 7/1996 Parker ..... E05C 19/184 292/289
6,378,917 B1 * 4/2002 Jones ..... E05C 19/184 292/DIG. 15
8,414,040 B1 * 4/2013 Rhodes ..... E05C 17/50 292/288
2014/0217754 A1 * 8/2014 Taylor ..... E05C 19/184 292/288

* cited by examiner

*Primary Examiner* — Alyson M Merlino
(74) *Attorney, Agent, or Firm* — Northern Michigan Patent Law, PLC

(57) ABSTRACT

A door security system is provided which is used to prevent a door, which separates first and second spaces, from opening. The door security system includes a security apparatus which is configured to be engaged with the floor within a first space. If the door is to be opened into the first space, the security apparatus blocks the door from opening into the first space. If the door is to be opened into the second space, an attachment assembly of the door security system acts in concert with the attachment assembly to block the door from opening into the second space. The door security system further includes a release mechanism which can be manipulated from the second space to disengage the security apparatus within the first space, thereby allowing for the door to be opened into either the first or second spaces, as appropriate.

19 Claims, 32 Drawing Sheets

FIG. 1
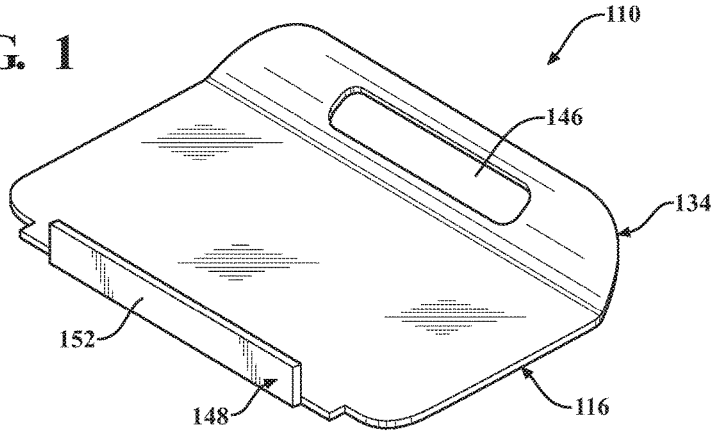
FIG. 2
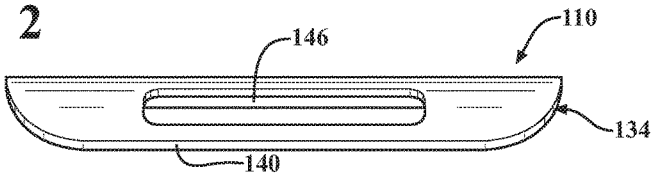
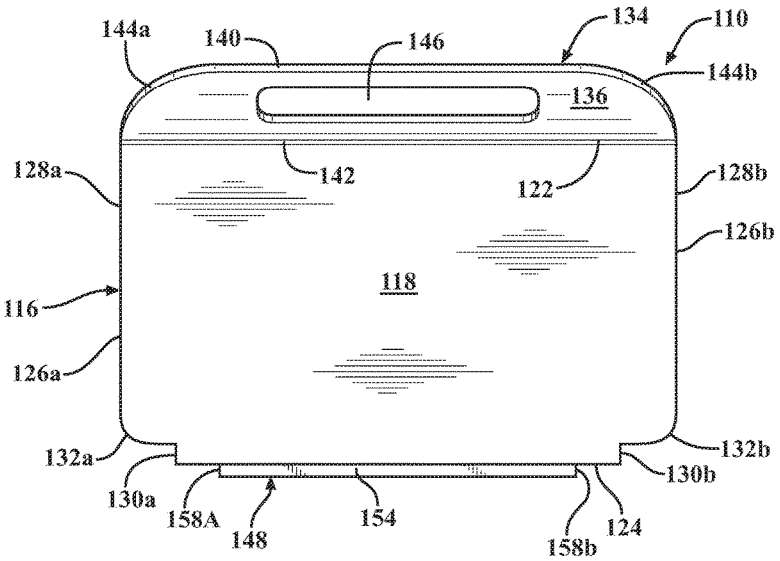
FIG. 3
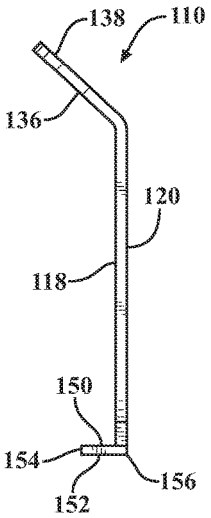
FIG. 4

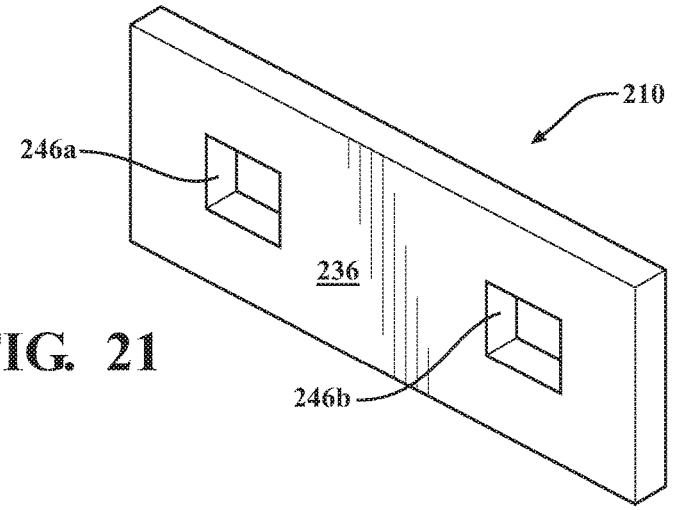
FIG. 21
FIG. 22
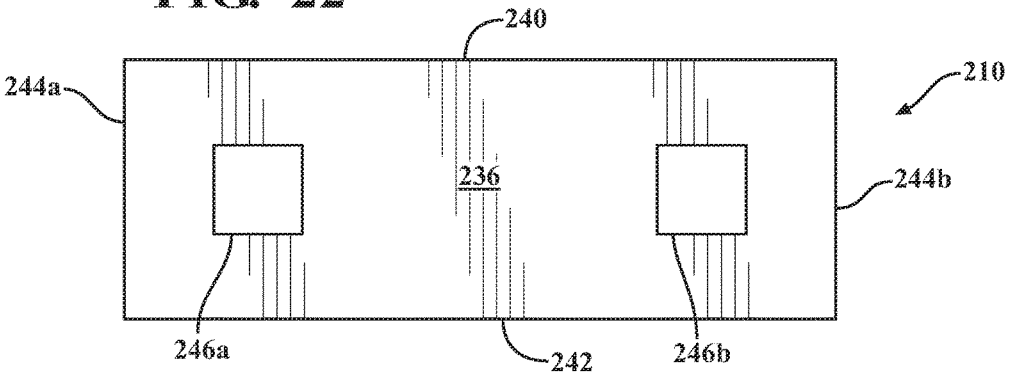
FIG. 23
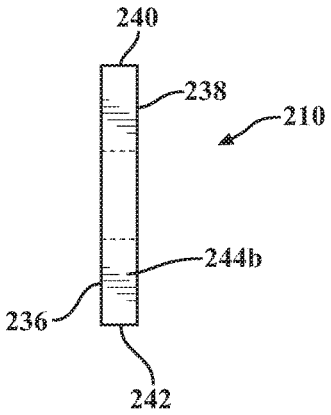

DOOR SECURITY SYSTEM AND METHOD OF USING SAME

CROSS-REFERENCE AND INCORPORATION BY REFERENCE

This patent application claims the domestic priority of U.S. Provisional Patent Application Ser. No. 61/812,410, filed Apr. 16, 2013, and entitled "Security Apparatus And Method For Doors". U.S. Provisional Patent Application Ser. No. 61/812,410 is hereby incorporated by reference in its entirety.

FIELD OF THE INVENTION

The invention relates to a security system and, more particularly, a door security system and a method of using same.

BACKGROUND OF THE INVENTION

Security for residential homes and commercial buildings, offices, storage, schools, universities, and the like, is of concern for all the owners and/or occupants of those properties and particularly in areas where high concentrations of breaking and entering or other crimes occur. The security for these types of real estate properties is riddled with various security inventions or devices. All of these various security inventions or devices are well-known in the prior art and, depending upon the criminal, provide a deterrent to an unauthorized entry and/or at least provide an obstacle to the unauthorized entry that may facilitate a sufficient amount of time for a third party to witness the crime and report it to the proper authorities before the criminal can commit further crimes related to the real estate property or occupants of the real estate property.

In many instances, it may be desirable to prevent a door from being opened so as to prevent (or at least delay) an unauthorized person from entering the room and gaining access to the people and/or items in the room. There are a number of security devices that can be installed on a door to prevent the opening of the door, including dead bolts, chain locks, alarm systems, etc. While many of these security devices may assist in at least delaying an unauthorized person from entering a room, these security devices likely will not prevent an unauthorized person from entering a room. There are further security devices that may be installed across a door frame or secured to a floor that can prevent a door from being opened into the room, but these security devices are not known to be able to operate effectively when the door is opened outwardly. Furthermore, these types of security devices are generally prohibited under most, if not all, jurisdictional fire codes because they cannot be disengaged or removed from outside of the room and, therefore, such security devices are not usable in certain environments which must comply with jurisdictional fire codes, such as schools and office buildings.

The present invention provides a door security system, and a method of using same, which seeks to overcome the disadvantages of prior art door security systems.

SUMMARY OF THE INVENTION

A first preferred embodiment of the invention provides a door security system for use in connection with a door. The door security system has a security apparatus and a release mechanism. The security apparatus has a floor engaging portion and a door blocking portion. The security apparatus is provided in a first space adjacent to a first side of the door. The door blocking portion is configured to block the door from opening into the first space. The floor engaging portion is configured to engage a floor provided in the first space in a manner which retains the security apparatus in place relative to the floor. The release mechanism has a handle portion and a security apparatus engaging portion. The handle portion is provided in a second space adjacent to a second side of the door. The security apparatus engaging portion is connected to the handle portion and extends into the first space via a slot provided between a bottom of the door and the floor. The handle portion is configured to be manipulated to cause the security apparatus engaging portion to engage the security apparatus in a manner which causes the floor engaging portion to disengage from the floor.

The first embodiment of the door security apparatus preferably further includes a receiving assembly. The receiving assembly is provided in the floor provided in the first space. The receiving assembly is configured to receive the floor engaging portion of the security apparatus therein, thereby allowing the floor engaging portion to engage the floor provided in the first space.

The first embodiment of the door security apparatus preferably further includes an attachment assembly. The attachment assembly is configured to be secured to the door and to provide a slot between the first side of the door and the attachment assembly. The door blocking portion of the security apparatus is configured to be positioned within the slot when the floor engaging portion of the security apparatus is engaged with the floor. The attachment assembly is configured to block the door from opening into the second space.

The first embodiment of the door security apparatus the security apparatus preferably has a handle portion. The handle portion is connected to the door blocking portion of the security apparatus.

A second preferred embodiment of the invention provides a door security apparatus. The door security apparatus includes a security apparatus having a first portion which is configured to block a door from being opened into a first space, and a second portion which is configured to engage a floor inside the first space. The first portion has a door facing surface and a first space facing surface. The second portion comprises a pair of pins which are secured to the room facing surface of the first portion and which extend below the first portion to engage the floor inside the first space, whereby, when the second portion is engaged with the floor, the security apparatus inhibits the door from opening into the first space.

The first portion of the second embodiment preferably includes a floor stop member which extends inwardly from the space facing surface, and away from the door facing surface. The floor stop member is positioned between the pair of pins.

The security apparatus of the second embodiment preferably further includes a support plate which is secured to the room facing surface and which extends inwardly from the room facing surface, and away from the door facing surface. The support plate is positioned between the pair of pins, and above the stop member such that a channel is defined between the support plate and the stop member.

The door security system of the second embodiment preferably includes a release mechanism which is configured to be manipulated from a second space which is provided on an opposite side of the door from the first space. The release mechanism is configured to be engaged within the channel of the security apparatus to disengage the second portion of the security apparatus from the floor.

The door security system of the second embodiment preferably includes a pair of sleeves which each have an aperture provided therethrough. Each sleeve is configured to be positioned within a corresponding hole formed in the floor of the first space. Each sleeve is configured to receive a portion of one of the pins therein, thereby engaging the pins with the floor.

The security apparatus of the second embodiment preferably further includes a third portion which is secured to the first portion. The third portion has an aperture provided therethrough such that the third portion is configured to act as a handle portion of the security apparatus. Each pin is secured to the third portion and the aperture is provided between the pins.

The door security system of the second embodiment preferably further includes an attachment assembly which is configured to be secured to the door and to provide a slot between the door and the attachment assembly. The first portion of the security apparatus is configured to be positioned within the slot when the second portion of the security apparatus is engaged with the floor, thereby preventing the door from opening into the second space.

The security apparatus of the second embodiment preferably further includes a third portion which is secured to the first portion. The third portion has an aperture provided therethrough such that the third portion is configured to act as a handle portion of the security apparatus. The third portion extends from a top of the first portion in an upward and inward manner from the room facing surface, and away from the door facing surface.

A third preferred embodiment of the invention provides a method of using a door security system. The method includes the steps of: providing a door which separates a first space from a second space; providing a floor in the first and second spaces, the door being positioned over the floor, the door being separated from the floor to define a gap between the door and the floor; providing a security apparatus having a floor engaging portion and a door blocking portion, the security apparatus being provided in the first space adjacent to a first side of the door; providing a mechanism having a handle portion and a security apparatus engaging portion, the security apparatus engaging portion being connected to the handle portion, the mechanism being provided in the second space; engaging the floor engaging portion of the security apparatus with the floor provided, in the first space, thereby retaining the security apparatus in place relative to the floor, and thereby causing the door blocking portion to block the door from opening into the first space; moving the security engaging portion of the mechanism through the gap to provide that at least a portion of the security apparatus engaging portion of the mechanism is positioned in the second space; and manipulating the handle portion of the mechanism to cause the security apparatus engaging portion of the release mechanism to engage the security apparatus in a manner which causes the floor engaging portion to disengage from the floor in the first space.

The method of the third embodiment further preferably includes the steps of: providing a receiving assembly in the floor provided in the first space; and engaging the floor engaging portion of the security apparatus with the receiving assembly, thereby retaining the security apparatus in place relative to the floor, and thereby causing the door blocking portion to block the door from opening into the first space.

The method of the third embodiment further preferably includes the steps of: providing an attachment assembly; securing the attachment assembly to the door to provide a slot between the first side of the door and the attachment assembly; and positioning the security apparatus within the slot, thereby causing the security apparatus and the attachment assembly to block the door from opening into the second space.

A fourth embodiment of the invention provides a method of using a door security system. The method includes the steps of: providing a door which separates a first space from a second space; providing a floor in the first and second spaces, the door being positioned over the floor, the floor having a pair of holes therein in the first space; providing a security apparatus of the door security system in the first space, the security apparatus comprising first and second portions, the first portion having first and second opposite surfaces, the second portion has a pair of pins which are secured to the second surface of the first portion and which extend below the first portion; positioning the first surface of the first portion of the security apparatus to face the door; positioning the pair of pins of the security apparatus over the pair of holes provided in the floor of the first space; and lowering the pair of pins of the security apparatus into the pair of holes provided in the floor of the first space, thereby engaging the security apparatus with the floor, and thereby allowing for the first portion of the security apparatus to block the door from opening into the first space.

The method of the fourth embodiment further preferably includes the steps of: providing the first portion with a floor stop member which extends inwardly from the second surface of the first portion, and away from the, first surface of the first portion, the floor stop member being positioned between the pair of pins; and lowering the pair of pins of the security apparatus into the pair of holes provided in the floor of the first space until the floor stop member is prevented from further downward movement relative to the floor of the first space.

The method of the fourth embodiment further preferably includes the steps of: providing the security apparatus with a support plate which is secured to the first surface of the first portion and which extends inwardly from the first surface of the first portion, and away from the second surface of the first portion, the support plate being positioned between the pair of pins, the support plate being positioned above the stop member such that a channel is defined between the support plate and the stop member; providing a gap between a bottom of the door and the floor; providing a release mechanism having a handle portion and a security apparatus engaging portion; manipulating the release mechanism from the second space to position the handle portion in the second space and the security apparatus engaging portion in the first space, with the release mechanism spanning the gap between the bottom of the door and the floor; manipulating the handle portion of the release mechanism to cause the security apparatus engaging portion to be positioned within the channel of the security apparatus; and manipulating the handle portion of the release mechanism to cause the security apparatus engaging portion to engage the security apparatus within the channel to disengage the pins of the security apparatus from the floor in the first space.

The method of the fourth embodiment preferably further includes the steps of: providing a pair of sleeves which each have an aperture provided therethrough; positioning the pair of sleeves into the pair of holes provided in the floor of the first space; and lowering the pair of pins of the security apparatus into the apertures of the pair of sleeves, thereby engaging the security apparatus with the floor, and thereby allowing for the first portion of the security apparatus to block the door from opening into the first space.

The method of the fourth embodiment preferably further includes the steps of: providing an attachment assembly; securing the attachment assembly to the door to provide a slot between the door and the attachment assembly, the slot being provided in the first space and being positioned above the pair of holes in the floor in the first space; positioning the security apparatus over the slot; positioning the first surface of the first portion of the security apparatus to face the door; positioning the pair of pins of the security apparatus over the pair of holes provided in the floor of the first space; and lowering the pair of pins of the security apparatus through the slot and into the pair of holes provided in the floor of the first space, thereby engaging the security apparatus with the floor, securing the security apparatus within the slot, allowing for the first portion of the security apparatus to block the door from opening into the first space, and allowing for the attachment assembly and the security apparatus to block the door from opening into the second space.

BRIEF DESCRIPTION OF THE DRAWINGS

For a more complete understanding of the disclosure, reference may be made to the following detailed description and accompanying drawings wherein like reference numerals identify like elements in which:

FIG. 1 is a perspective view of a main plate of a security apparatus forming part of a door security system of a preferred embodiment of the invention;

FIG. 2 is a top view of the main plate illustrated in FIG. 1;

FIG. 3 is a front view of the main plate illustrated in FIG. 1;

FIG. 4 is a side view of the main plate illustrated in FIG. 1;

FIG. 21 is a perspective view of a washer plate of the attachment assembly forming part of the door security system of the preferred embodiment of the invention;

FIG. 22 is a rear view of the washer plate illustrated in FIG. 21;

FIG. 23 is a side view of the washer plate illustrated in FIG. 21;

DETAILED DESCRIPTION OF THE ILLUSTRATED EMBODIMENTS

Figure 5:
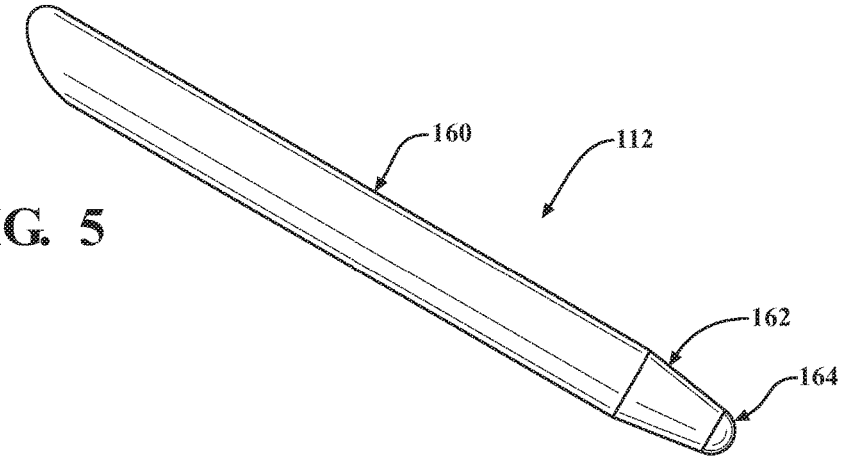
FIG. 5 is a perspective view of a pin of the security apparatus forming part of the door security system of the preferred embodiment of the invention.

While the present disclosure is susceptible to various modifications and alternative forms, certain embodiments are shown by way of example in the drawings and these embodiments will be described in detail herein. It will be understood, however, that this disclosure is not intended to limit the invention to the particular form described, but to the contrary, the invention is intended to cover all modifications, alternatives, and equivalents falling within the spirit and scope of the invention defined by the appended claims.

A door security system 100 is provided which includes a security apparatus 102, a pair of sleeves 104, an attachment assembly 106, and a release mechanism 108.

The security apparatus 102 is best illustrated in FIGS. 1-14. The security apparatus 102 includes a main plate 110, a pair of pins 112, and a support plate 114.

As best illustrated in FIGS. 1-4, the main plate 110 includes a middle portion 116 having a front surface 118 and a rear surface 120. The middle portion 116 has a top edge 122, a bottom edge 124, and a pair of side edges 126*a*, 126*b* which connect the top edge 122 to the bottom edge 124. The bottom edge 124 has a length which is preferably less than a length of the top edge 122. Each side edge 126*a*, 126*b* preferably has a first side edge portion 128*a*, 128*b*, a second side edge portion 130*a*, 130*b*, and a third side edge portion 132*a*, 132*b*. The first side edge portions 128*a*, 128*b* extend vertically downwardly front opposite ends of the top edge 122. The third side edge portions 132*a*, 132*b* extend vertically upwardly from opposite ends of the bottom edge 124. The second side edge portions 130*a*, 130*b* curve downwardly and inwardly from the first side edge portions 128*a*, 128*b* to the third side edge portions 132*a*, 132*b*.

The main plate 110 includes a top portion 134. The top portion 134 has a front surface 136 and a rear surface 138. The top portion 134 has a top edge 140, a bottom edge 142, and a pair of side edges 144*a*, 144*b* which connect the top edge 140 to the bottom edge 142. The top edge 140 has a length which is preferably less than a length of the bottom edge 142. The side edges 144*a*, 144*b* preferably curve downwardly and outwardly from the top edge 140 to the bottom edge 142. An aperture 146 is preferably provided through the top portion 134 generally equidistantly between the side edges 144*a*, 144*b*. The aperture 146 is preferably generally rectangular in configuration, but preferably is rounded at its corners.

The main plate 110 includes a bottom portion 148. The bottom portion 148 has a top surface 150 and a bottom surface 152. The bottom portion 148 has a front edge 154, a rear edge 156, and a pair of side edges 158*a*, 158*b* which connect the front edge 154 to the rear edge 156. The front and rear edges 154, 156 preferably have identical lengths and the top and bottom surfaces 150, 152 are preferably rectangular in configuration.

The middle, top, and bottom portions 116, 134, 148 of the main plate 110 are all preferably integrally formed. The bottom edge 142 of the top portion 134 is connected to the top edge 122 of the middle portion 116, with the bottom edge 142 and the top edge 122 preferably having identical lengths. The top portion 134 is angled relative to the middle portion 116, preferably at an angle of forty-five (45) degrees. The top surface 150 of the bottom portion 148 is connected to the bottom edge 124 of the middle portion 116, such that the rear surface 120 of the middle portion 116 is generally flush with the rear edge 156 of the bottom portion 148. The bottom portion 148 has a length which is less than a length of the bottom edge 124 of the middle portion 116 such that equal parts of the bottom edge 124 of the middle portion 116 are exposed on either side of the bottom portion 148. The bottom portion 148 is thus angled relative to the middle portion 116, preferably at an angle of ninety (90) degrees.

Figure 6:
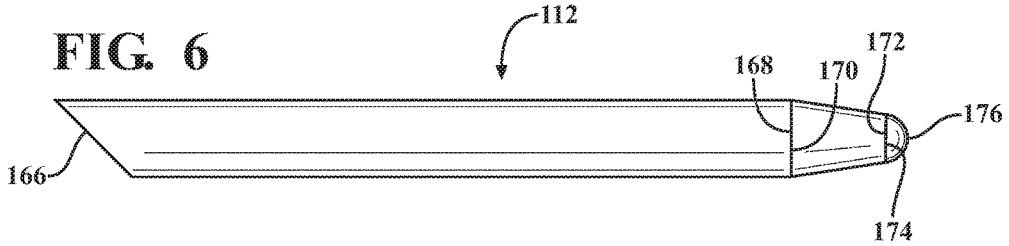
FIG. 6 is a side view of the pin illustrated in FIG. 5.
Figure 7:
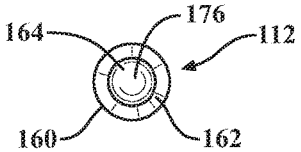
FIG. 7 is a bottom view of the pin illustrated in FIG. 5.

The pins 112 of the security apparatus 102 are best illustrated in FIGS. 5-7. The pins 112 include a generally cylindrical portion 160, a generally conical portion 162, and a generally domed portion 164, each of which are preferably integrally formed. The generally cylindrical portion 160 has a top edge 166 which is generally formed at an angle, preferably forty-five (45) degrees, and a bottom edge 168. The generally conical portion 162 has a top edge 170 and a bottom edge 172, where the top edge 170 has a larger diameter than the bottom edge 172. The generally domed portion 164 has a top edge 174 and a bottom point 176. The bottom edge 168 of the generally cylindrical portion 160 and the top edge 170 of the generally conical portion 162 are connected to one another and preferably have the same diameter. The bottom edge 172 of the generally conical portion 162 and the top edge 174 of the generally domed portion 164 are connected to one another and preferably have the same diameter.

Figure 8:
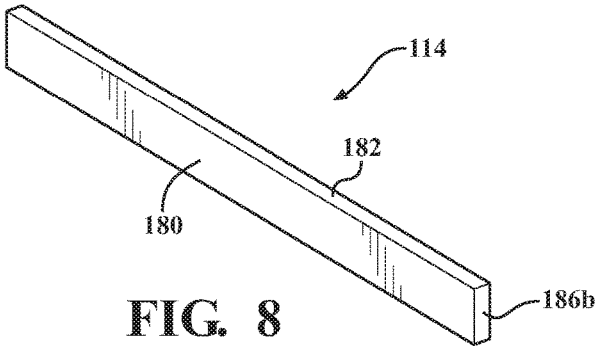
FIG. 8 is a perspective view of a support plate of the security apparatus forming part of the door security system of the preferred embodiment of the invention.
Figure 9:
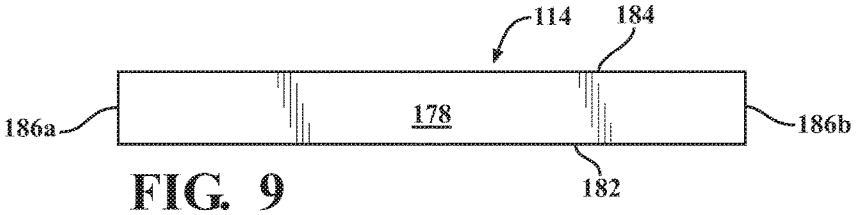
FIG. 9 is a top view of the support plate illustrated in FIG. 8.
Figure 10:
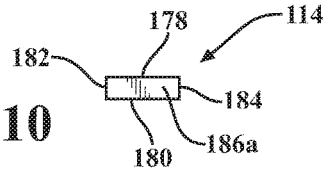
FIG. 10 is a side view of the support plate illustrated in FIG. 8.
Figure 11:
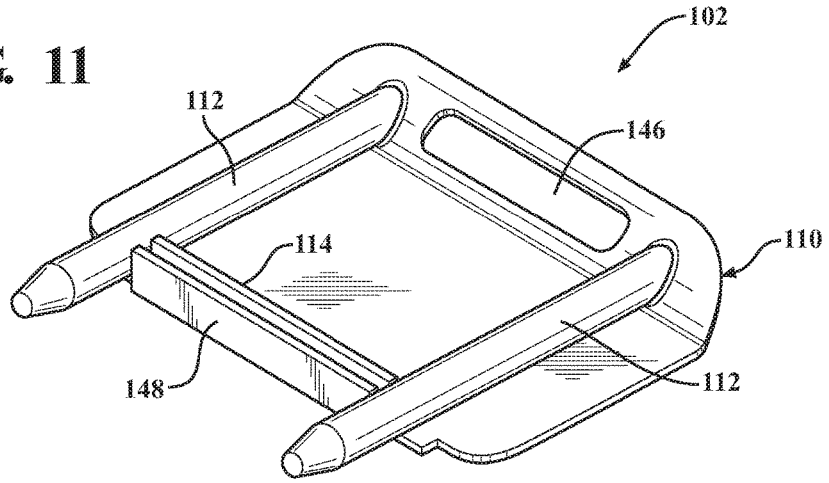
FIG. 11 is a perspective view of the security apparatus forming part of the door security system of the preferred embodiment of the invention.
Figure 12:
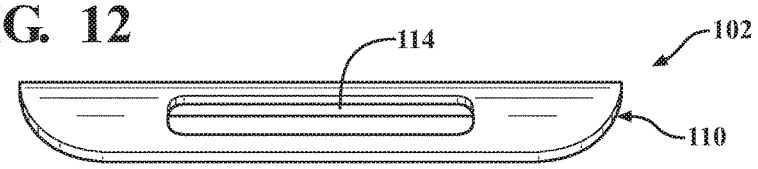
FIG. 12 is a top view of the security apparatus illustrated in FIG. 11.
Figure 13:
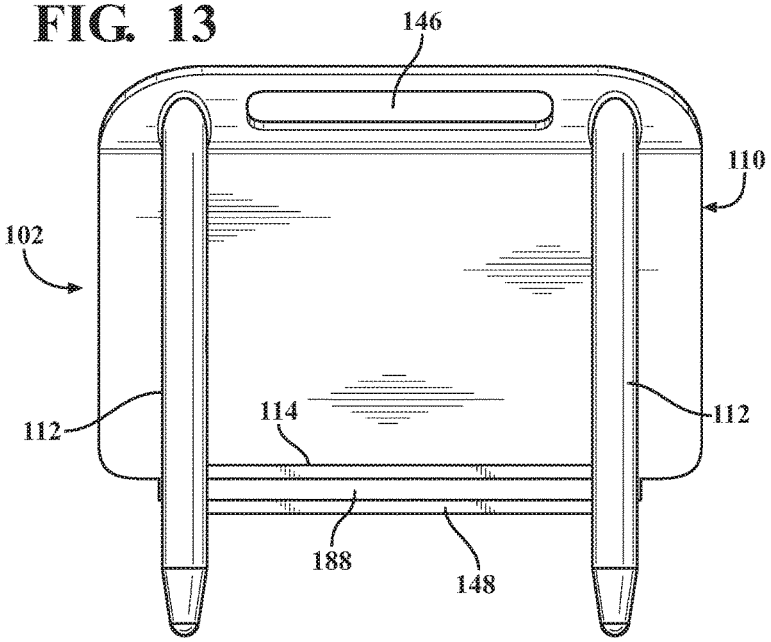
FIG. 13 is a front view of the security apparatus illustrated in FIG. 11.
Figure 14:
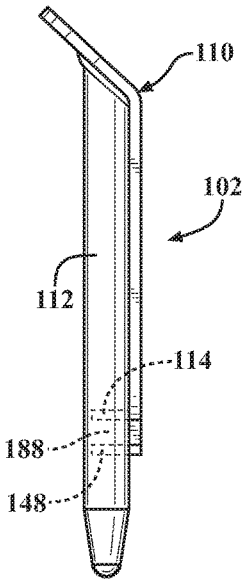
FIG. 14 is a side view of the security apparatus illustrated in FIG. 11.

The support plate 114 of the security apparatus 102 is best illustrated in FIGS. 8-10. The support plate 114 includes a top surface 178 and a bottom surface 180. The support plate 114 has a front edge 182, a rear edge 184, and a pair of side edges 186*a*, 186*b* which connect the front edge 182 to the rear edge 184. The front and rear edges 182, 184 preferably have identical lengths and the top and bottom surfaces 178, 180 are preferably rectangular in configuration.

The security apparatus 102 is formed by welding the main plate 110, the pair of pins 112, and the support plate 114 together. More specifically, the pins 112 are positioned on opposite sides of the bottom portion 148 of the main plate 110 so that the generally cylindrical portion 160 of each pin 112 is positioned against the front surface 118 of the middle portion 116 of the main plate 110 and such that the angled top edges 166 of the generally cylindrical portions 160 are positioned flat against the front surface 136 of the top portion 134 of the main plate 110. The generally cylindrical portions 160 of the pins 112 are preferably slightly distanced from the side edges 158*a*, 158*b* of the bottom portion 148 of the main plate 110, and a lower portion of the generally cylindrical portions 160, as well as the generally conical portions 162, and the generally domed portions 164, of the pins 112, are positioned below the bottom portion 148 of the main plate 110. The pins 112 are preferably welded to the main plate 110 at least at the connection of the angled top edges 166 of the generally cylindrical portions 160 to the front surface 136 of the top portion 134 of the main plate 110. The pins 112 may further be welded to the main plate 110 at other positions as desired.

The rear edge 184 of the support plate 114 is positioned against the front surface 118 of the middle portion 116 of the main plate 110, at a predefined distance above the bottom portion 148 of the main plate 110, preferably generally in alignment with the connection of the second and third side edges 130*a*, 132*a*; 130*b*, 132*b* of the middle portion 116 of the main plate 110. Thus, an elongated channel 188 is defined between the top surface 150 of the bottom portion 148 of the main plate 110 and the bottom surface 180 of the support plate 114. The support plate 114 preferably has a length which is equal to a length of the bottom portion 148 of the main plate 110, and the support plate 114 is generally provided in general alignment with, and in parallel relation to, the bottom portion 148 of the main plate 110. The generally cylindrical portions 160 of the pins 112 are preferably slightly distanced from the side edges 186*a*, 186*b* of the support plate 114. The support plate 114 is preferably welded to one or more of the middle portion 116 of the main plate 110 and the pins 112.

The security apparatus 102 of the door security system 100 is thus formed, as illustrated in FIGS. 11-14.

Figure 15:
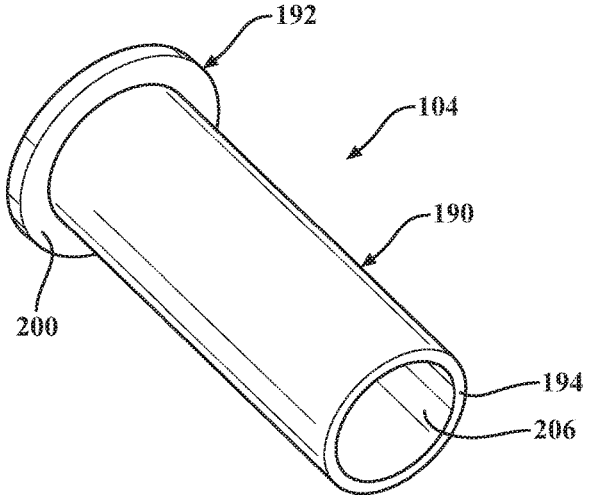
FIG. 15 is a perspective view of a sleeve forming part of the door security system of the preferred embodiment of the invention.
Figure 16:
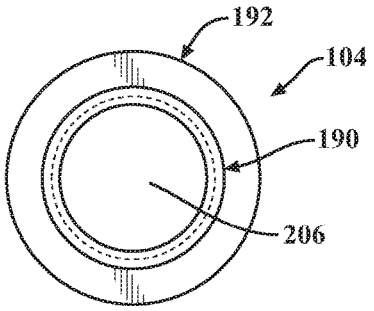
FIG. 16 is a bottom view of the sleeve illustrated in FIG. 15.
Figure 17:
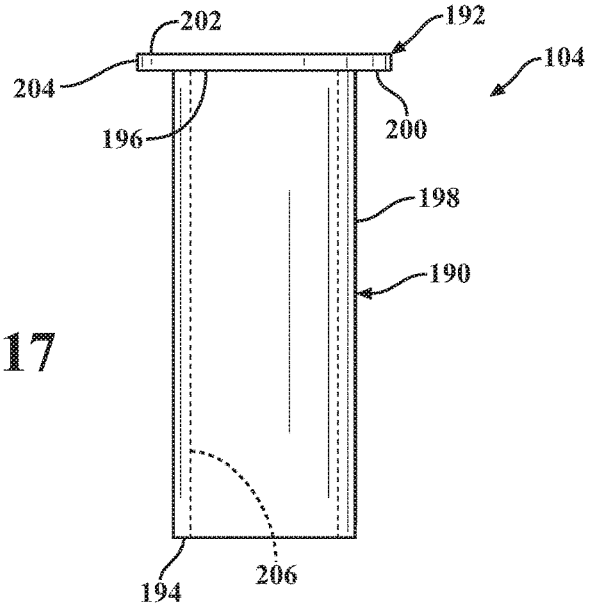
FIG. 17 is a front view of the sleeve illustrated in FIG. 15.

The sleeves 104 of the door security system 100 are best illustrated in FIGS. 15-17. Each sleeve 104 is preferably formed of aluminum, but may be formed of any other suitable material. Each sleeve 104 has a shank portion 190 and a head portion 192 which are preferably integrally formed. The shank portion 190 is generally elongated and cylindrical in configuration and has a bottom end 194, a top end 196, and a generally cylindrical outer surface 198. The head portion 192 has a bottom surface 200, a top surface 202, and a generally circular outer edge 204. The top end 196 of the shank portion 190 is connected to the bottom surface 200 of the head portion 192, and the generally circular outer edge 204 of the head portion 192 has a diameter which is larger than a diameter of the generally cylindrical outer surface 198 of the shank portion 190. The head portion 192 preferably has a small thickness for reasons which will become apparent herein. An aperture 206 extends through the sleeve 104 from the top surface 202 of the head portion 192 to the bottom end 194 of the shank portion 190. The aperture 206 may have a different dimension within the head portion 192 than in the shank portion 190.

The attachment assembly 106 of the door security system 100 is best illustrated in FIGS. 18-29. The attachment assembly 106 includes a strap plate 208, a pair of washer plates 210, a plurality of bolts 212, and a plurality of nuts 214.

Figure 18:
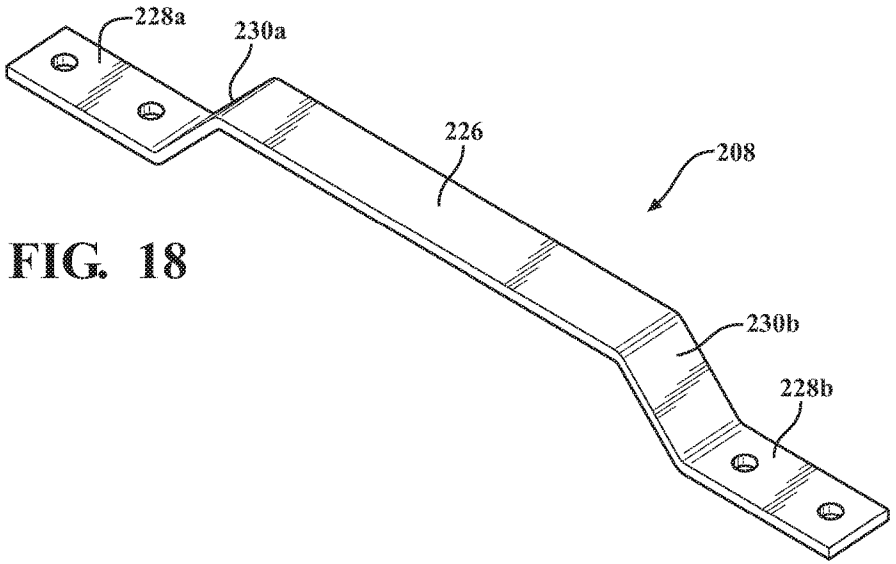
FIG. 18 is a perspective view of a strap plate of an attachment assembly forming part of the door security system of the preferred embodiment of the invention.
Figure 19:
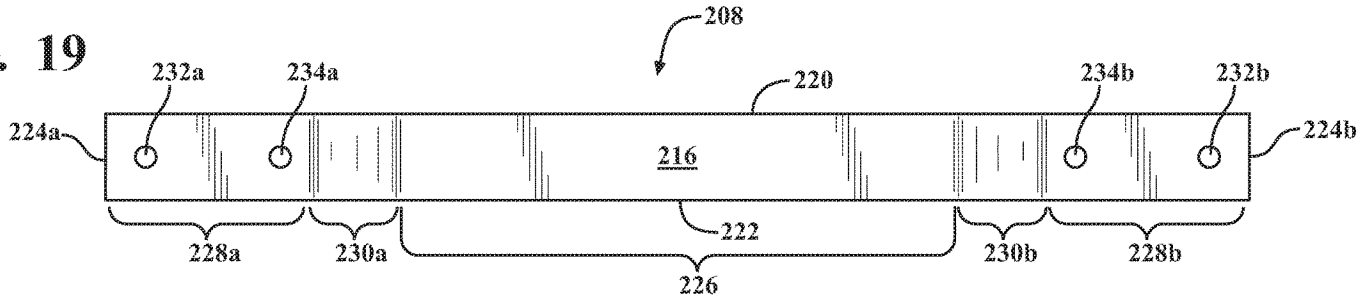
FIG. 19 is a front view of the strap plate illustrated in FIG. 18.
Figure 20:
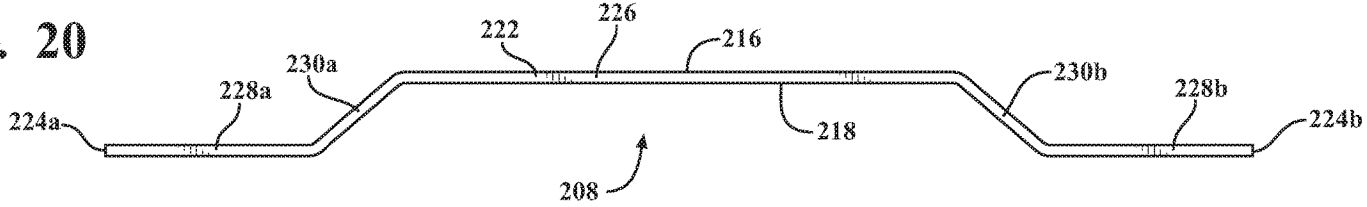
FIG. 20 is a bottom view of the strap plate illustrated in FIG. 18.

The strap plate 208 of the attachment assembly 106 is best illustrated in FIGS. 18-20. The strap plate 208 has a front surface 216, a rear surface 218, a top edge 220, a bottom edge 222, and opposite side edges 224*a*, 224*b* which connect the top edge 220 to the bottom edge 222. The strap plate 208 has a middle portion 226, opposite end portions 228*a*, 228*b*, and connecting portions 230*a*, 230*b*. Each of the middle portion 226, the end portions 228*a*, 228*b*, and the connecting portions 230*a*, 230*b* are preferably rectangular in configuration. The end portion 228*a* extends from the side edge 224*a* to the connecting portion 230*a*, and the end portion 228*b* extends from the side edge 224*b* to the connecting portion 230*b*. The connecting portion 230*a* extends angularly inwardly and forwardly from the end portion 228*a* to the middle portion 226, which the connecting portion 230*b* extends angularly inwardly and forwardly from the end portion 228*b* to the middle portion 226. The middle portion 226 is thus parallel to, but offset from, the end portions 228*a*, 228*b*, and the end portions 228*a*, 228*b* are separated from one another, but are planar with one another. The connecting portions 230*a*, 230*b* are preferably angled relative to each of the middle and end portions 226, 228*a*, 228*b* at approximately forty (40) to forty-five (45) degrees. Each of the end portions 228*a*, 228*b* preferably have a pair of apertures 232*a*, 234*a*; 232*b*, 234*b* provided therethrough. Each aperture 232*a*, 234*a*, 232*b*, 234*b* is preferably provided equidistant between the top edge 220 and the bottom edge 222. The apertures 232*a*, 232*b* are provided proximate to the side edges 224*a*, 224*b*, respectively, while the apertures 234*a*, 234*b* are provided distal to the side edges 224*a*, 224*b* and proximate to the connection of the end portions 228*a*, 228*b* and the connecting portions 230*a*, 230*b*.

The washer plate 210 of the attachment assembly 106 is best illustrated in FIGS. 21-23. Each washer plate 210 includes a front surface 236 and a rear surface 238. The washer plate 210 has a top edge 240, a bottom edge 242, and a pair of side edges 244*a*, 244*b* which connect the top edge 240 to the bottom edge 242. The top and bottom edges 240, 242 preferably have identical lengths and the front and rear surfaces 236, 238 are preferably rectangular in configuration. The washer plate 210 has a pair of apertures 246*a*, 246*b* provided therethrough. Each aperture 246*a*, 246*b* is preferably provided equidistant between the top edge 240 and the bottom edge 242. The aperture 246*a* is provided proximate to the side edge 244*a* while the apertures 246*b* is provided distal to the side edge 244*a* and proximate to the side edge 244*b*.

Figure 24:
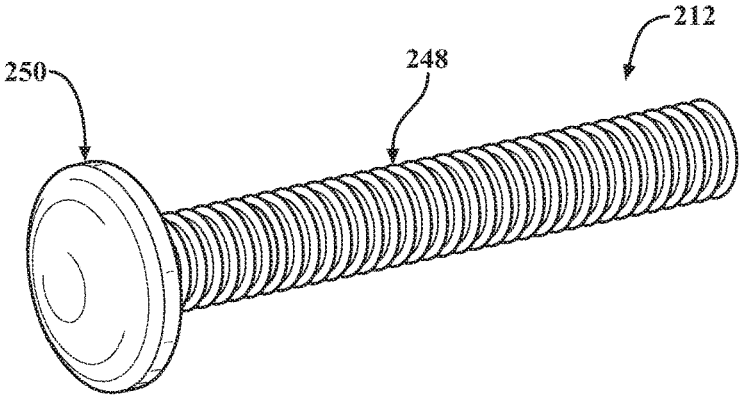
FIG. 24 is a perspective view of a bolt of the attachment assembly forming part of the door security system of the preferred embodiment of the invention.
Figure 25:
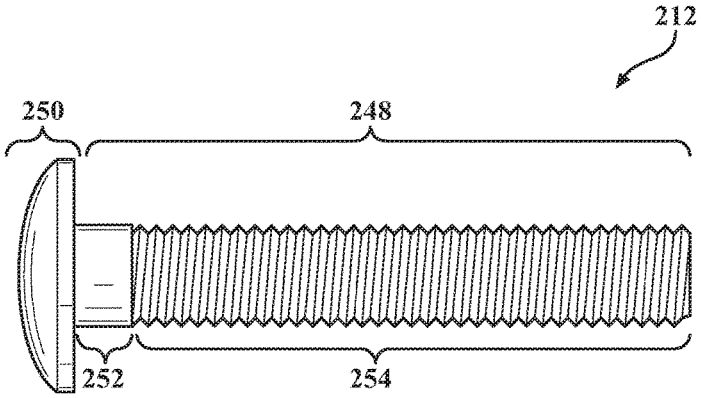
FIG. 25 is a side view of the bolt illustrated in FIG. 24.
Figure 26:
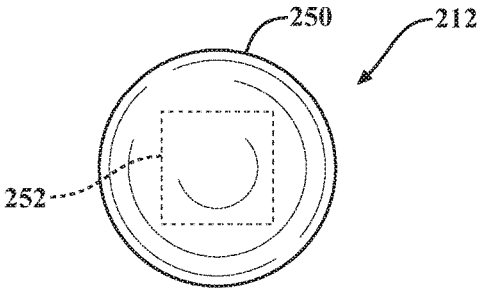
FIG. 26 is a top view of the bolt illustrated in FIG. 24.

The bolts 212 of the attachment assembly 106 are best illustrated in FIGS. 24-26. The attachment assembly 106 preferably includes four bolts 212. The bolts 212 are preferably round head, square neck bolts. Each bolt 212 has a shank portion 248 and a head portion 250 connected at one end of the shank portion 248. The head portion 250 is preferably domed in configuration and has a larger base diameter than a diameter of the shank portion 248. The shank portion has a generally square, non-threaded portion 252 proximate to the head portion 250 and a generally cylindrical, threaded portion 254 extending from the non-threaded portion 252 to a free end of the shank portion 248.

Figure 27:
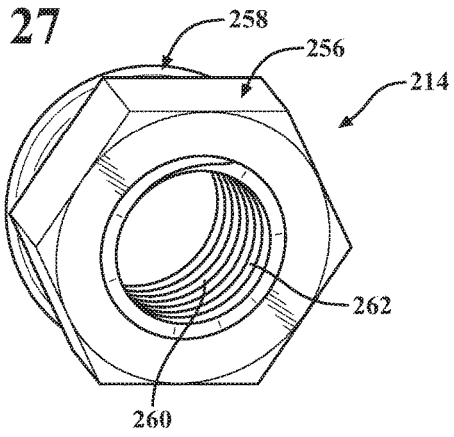
FIG. 27 is a perspective view of a nut of the attachment assembly forming part of the door security system of the preferred embodiment of the invention.
Figure 28:
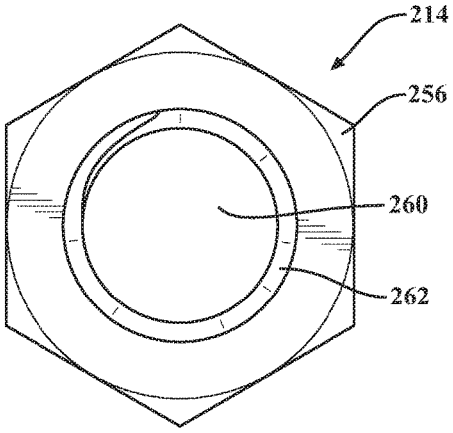
FIG. 28 is a bottom view of the nut illustrated in FIG. 27.
Figure 29:
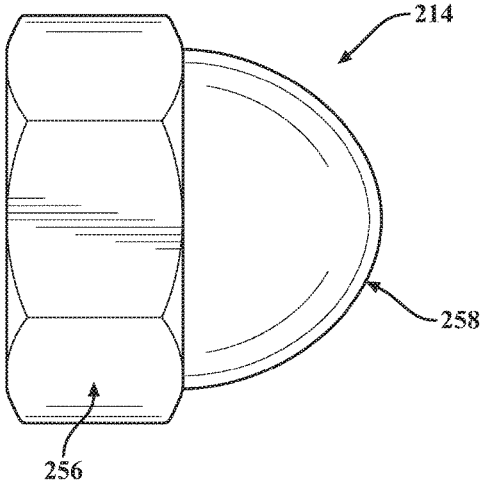
FIG. 29 is a side view of the nut illustrated in FIG. 27.

The nuts 214 of the attachment assembly 106 are best illustrated in FIGS. 27-29. The attachment assembly 106 preferably includes four nuts 214. The nuts 214 are preferably zinc-plated, steel acorn nuts. Each nut 214 has a hexagonal base portion 256 and a domed portion 258 which extends therefrom. An opening 260 is provided at the hexagonal base portion 256 and extends through the hexagonal base portion 256 and into the domed portion 258. The opening defines a wall 262 which is preferably threaded.

Figure 30:
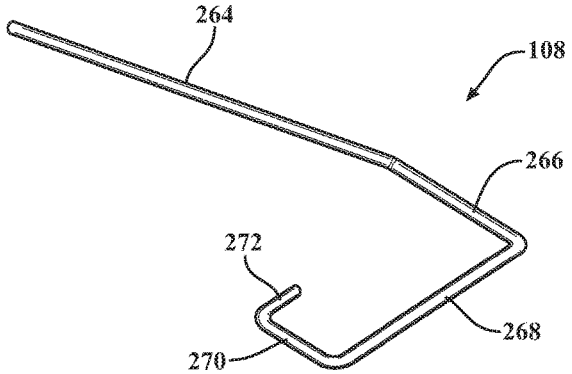
FIG. 30 is a perspective view of a release mechanism forming part of the door security system of the preferred embodiment of the invention.
Figure 31:
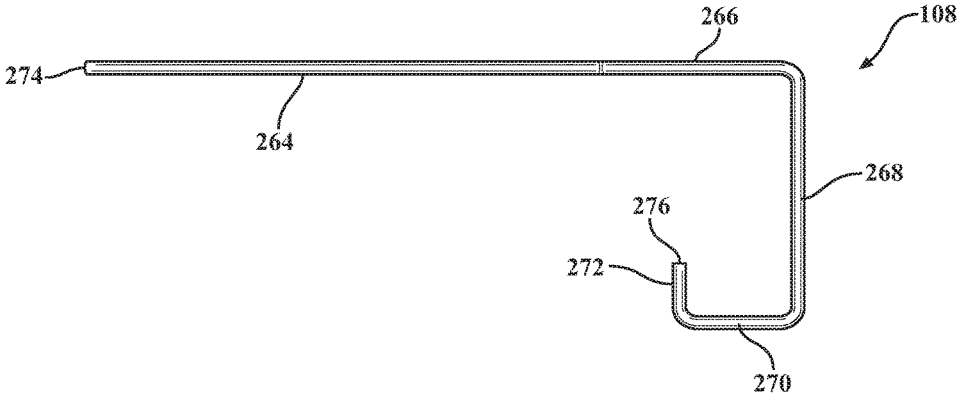
FIG. 31 is a top view of the release mechanism illustrated in FIG. 30.
Figure 32:
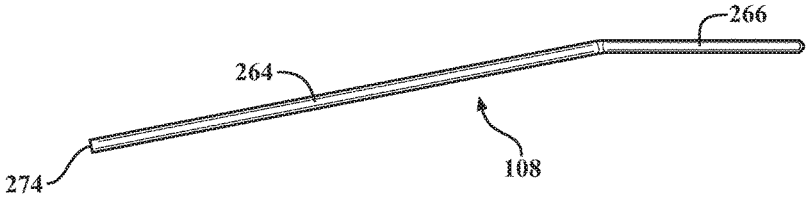
FIG. 32 is a side view of the release mechanism illustrated FIG. 30.

The release mechanism 108 is best illustrated in FIGS. 30-32. The release mechanism 108 is preferably formed of a rolled steel bar which has been bent to provide its desired configuration. More specifically, the release mechanism 108 has a first portion 264, a second portion 266, a third portion 268, a fourth portion 270, and a fifth portion 272. Each of the second, third, fourth, and fifth portions 266, 268, 270, 272 are planar with one another.

The first portion 264 extends from a first free end 274 of the release mechanism 108 to the second portion 266. The second portion 266 extends straight outwardly from the first portion 264 to the third portion 268, such that the first and second portions 264, 266 are in alignment with one another, but with the first portion 264 being provided at an angle relative to the second portion 266. The third portion 268 extends from the second portion 266 to the fourth portion 270, with the third portion 268 preferably being perpendicular to the second portion 266. The fourth portion 270 extends from the third portion 268 to the fifth portion 272, with the fourth portion 270 preferably being perpendicular to the third portion 268. The fourth portion 270 is preferably positioned opposite of, and in parallel position to, the second portion 266. The fifth portion 272 extends from the fourth portion 270 to a second free end 276 of the release mechanism 108, with the fifth portion 272 preferably being perpendicular to the fourth portion 270. The fifth portion 272 is preferably positioned opposite of, and in parallel position to, the third portion 268. The connections between the portions 264, 266, 268, 270, 272 are preferably smooth and curved. The third, fourth, and fifth portions 268, 270, 272 are generally provided in a J-shaped configuration. The first portion 264 is preferably longer than the third portion 268, the third portion 268 is preferably longer than the second portion 266, the second portion 266 is preferably longer than the fourth portion 270, and the fourth portion 270 is preferably longer than the fifth portion 272.

Each of the main plate 110, the pair of pins 112, and the support plate 114 of the security apparatus 102, the strap plate 208 and the washer plate 210 of the attachment assembly 106, and the release mechanism 108 are preferably made of steel. Alternatively, one or more of these parts may be made of aluminum, wood, or any other material known to one skilled in the art, provided that these alternative materials enable the door security system 100 to work in the manner as described hereinbelow. The sleeves 104 are preferably made of aluminum. Alternatively, the sleeves 104 may be made of steel, wood, plastic, or any other material known to one skilled in the art, provided that these alternative materials enable the door security system 100 to work in the manner as described hereinbelow.

Description of the installation and operation of the door security system 100 will now be described with reference to FIGS. 33-54. While the door security system 100 may be installed and operated in any type of setting having a door separating a first space from a second space, the door security system 100 will be described herein as being installed and operated in connection with a door 300, 400 which separates a classroom 500 (e.g., the first space) from a hallway 600 (e.g., the second space) in a school, where the classroom 500 and the hallway 600 share a common floor 700. Door 300 is defined as a door which opens into the classroom 500, whereas door 400 is defined as a door which opens into the hallway 600.

Figure 33:
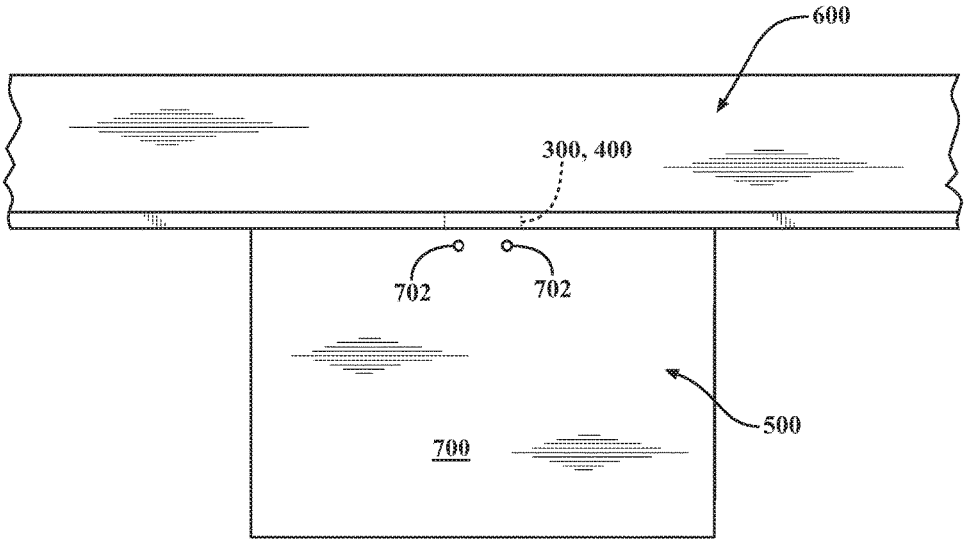
FIGS. 33-39 illustrate the initial installation of the door security system of the preferred embodiment of the invention.

Regardless of whether door 300 or door 400 is provided, initial installment of the door security system 100 is required and will be described with reference to FIGS. 33-39. Initial installment of the door security system 100 requires that a pair of holes 702 be formed in the floor 700 of the classroom 500, proximate to the door 300, 400, as illustrated in FIG. 33. The holes 702 are preferably provided on opposite sides of a center of the door 300, 400, but may be provided at any desired position along a base of the door 300, 400.

Figure 34:
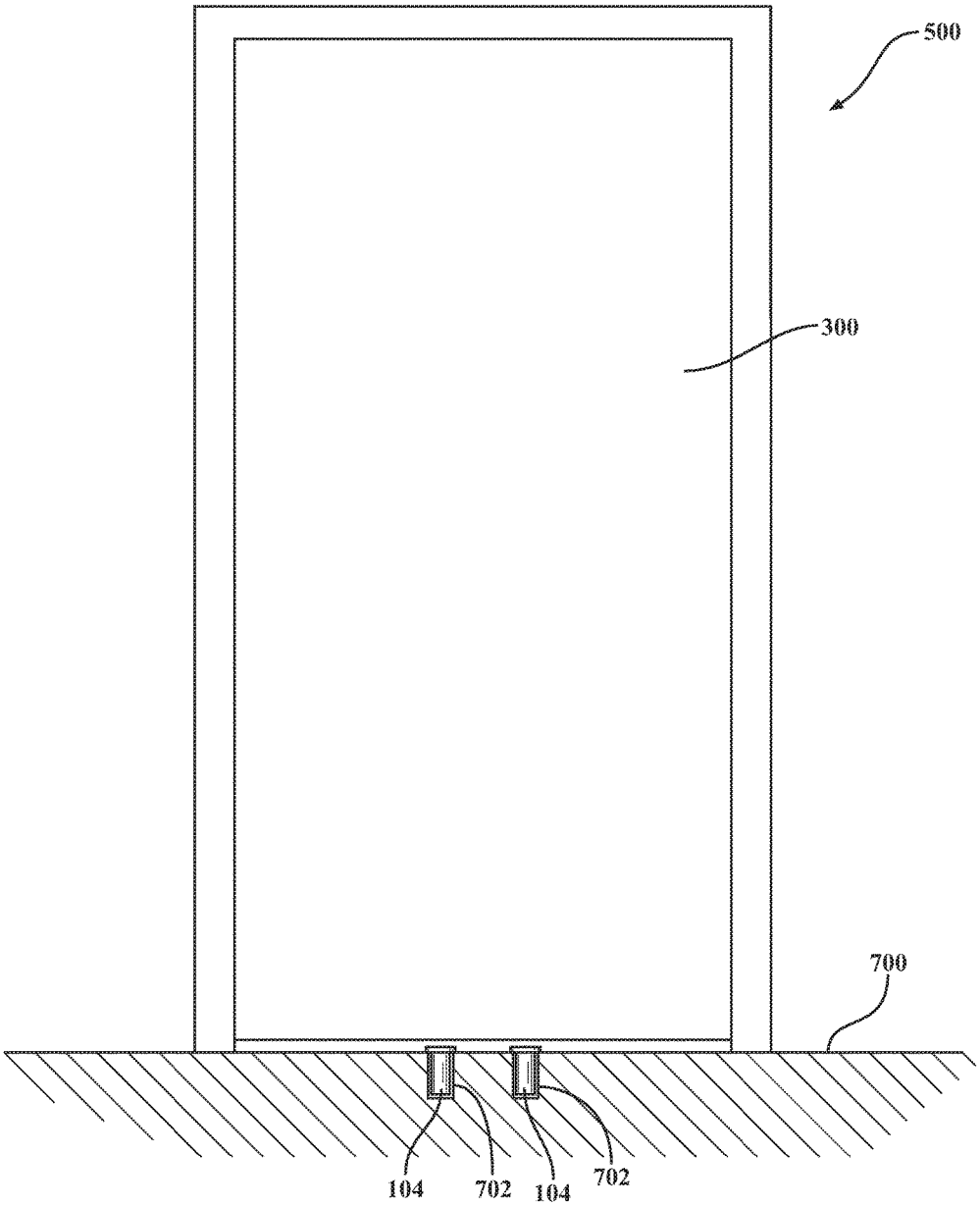

Once the holes 702 are formed, the sleeves 104 are preferably positioned in the holes 702 with the shank portions 190 being provided within the holes 702 and with the bottom surfaces 200 of the head portions 192 being positioned flat against the floor 700, as illustrated in FIG. 34. The sleeves 104 may be retained within the holes 702 and held in place relative to the floor 700 in any suitable manner, such as by an adhesive or an epoxy. Thus, the holes 702 must have a depth which is at least as large as a length of the shank portions 190 of the sleeves 104. As the top surface 202 and the circular outer edge 204 of the head portions 192 of the sleeves 104 are positioned above the floor 700, the thickness of the head portions 192 are preferably minimized as much as possible. In this regard, the head portions 192 do not prevent or impede the opening of the door 300 into the classroom 500 and, if desired, the circular outer edge 204 may taper from the bottom surface 200 to the top surface 202 (so that the top surface 202 has a smaller diameter than the bottom surface 200), or, alternatively, the head portions 192 may be entirely removed from the sleeves 104 so that the top end 196 of the shank portion 190 is generally flush with, or recessed from, the floor 700. As another option, the sleeves 104 may not be utilized at all, but this is not preferred.

In connection with door 400 only, initial installment of the attachment assembly 106 is also required, with reference to FIGS. 35-39. Also in connection with door 400 only, a gap 410 must be provided between the bottom of the door 400 and the floor 700 (a gap can be provided between the bottom of door 300 and the floor 700, but it is not required for operation of the door security system 100. When door 300 is provided between the classroom 500 and the hallway 600, the attachment assembly 106 of the door security system 100 is not installed, and the release mechanism 108 of the door security system 100 is not likely to be operated.

Figure 35:
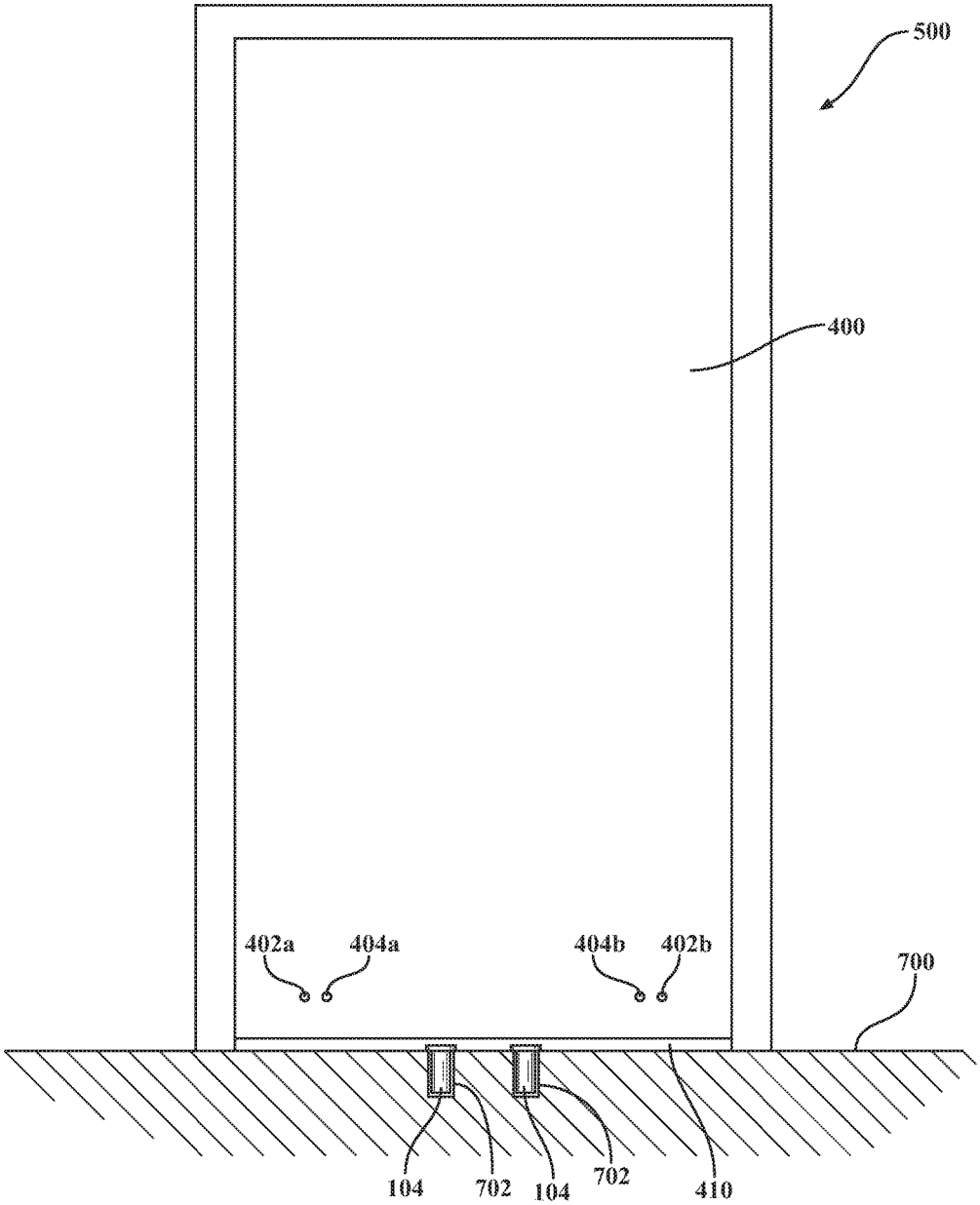

The attachment assembly 106 is installed by drilling first and second pairs of apertures 402*a*, 404*a*; 402*b*, 404*b* through the door 400, proximate to a lower end of the door 400. Of course, it is to be understood that the apertures 402*a*, 404*a*; 402*b*, 404*b* could be provided through the door in any desired manner. When viewed as in FIG. 35, it is apparent that the first pair of apertures 402*a*, 404*a* are provided to the left of the leftmost sleeve 104, while the second pair of apertures 402*b*, 404*b* are provided to the right of the rightmost sleeve 104. One pair of apertures 402*a*, 404*a*; 402*b*, 404*b* is preferably provided proximate to one of the sleeves 104, while the other pair of apertures 402*a*, 404*a*; 402*b*, 404*b* is preferably provided distal to the other one of the sleeves 104. As illustrated in FIG. 35, the second pair of apertures 402*b*, 404*b* is preferably provided proximate to the rightmost sleeve 104, while the first pair of apertures 402*a*, 404*a* is preferably provided distal to the leftmost sleeve 104.

Figure 36:
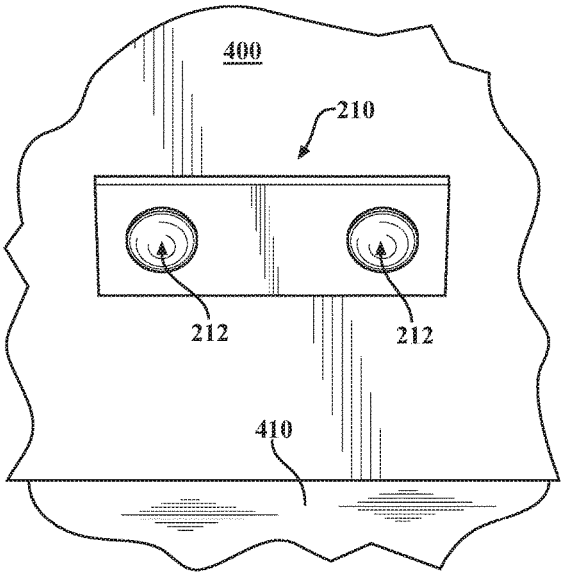
Figure 37:
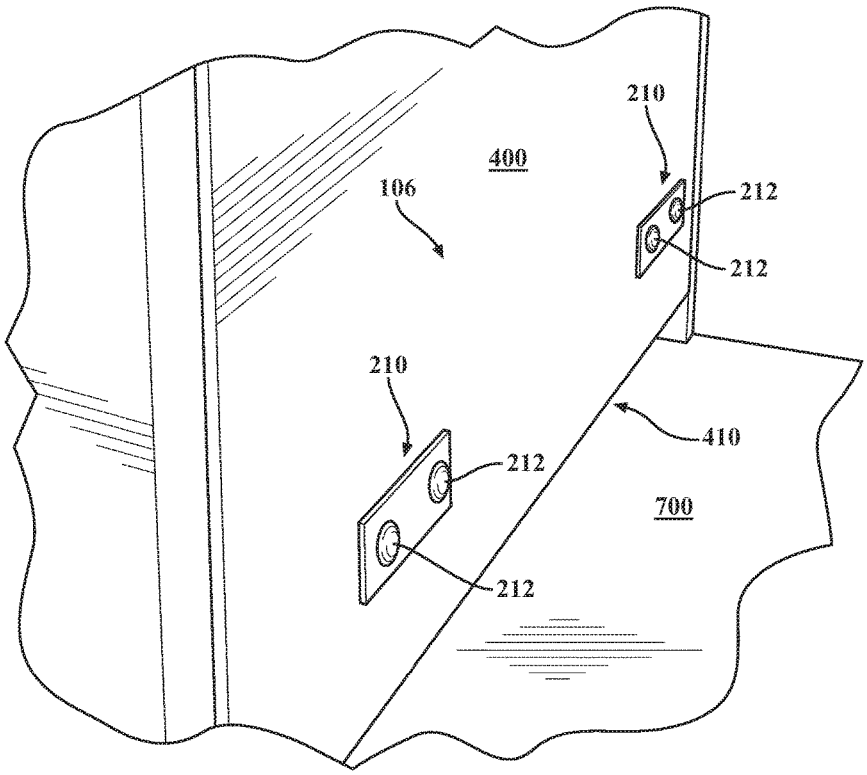

With the apertures 402*a*, 404*a*; 402*b*, 404*b* properly provided in the door 400, each of the washer plates 210 are positioned to have their front surfaces 236 positioned against the side or surface of the door 400 which faces the hallway 600, as illustrated in FIGS. 36 and 37. One washer plate 210 is positioned so that the aperture 246*a* is in alignment with the aperture 402*a*, and so that the aperture 246*b* is in alignment with the aperture 404*a*. The other washer plate 210 is positioned so that the aperture 246*a* is in alignment with the aperture 404*b*, and so that the aperture 246*b* is in alignment with the aperture 402*b*.

Each of the four bolts 212 are then inserted, shank portion 248 first, through the aligned apertures 246*a*, 402*a*; 246*b*, 404*a*; 246*a*, 404*b*; 246*b*, 402*b* until the base of the head portion 250 abuts against the rear surfaces 238 of the washer plates 210, as illustrated in FIGS. 36 and 37. When the base of the head portions 250 of the bolts 212 abut against the rear surfaces 238 of the washer plate 210, portions of the threaded portions 254 of the shank portions 248 of the bolts 212 will extend outwardly from the apertures 402*a*, 404*a*, 402*b*, 404*b* and into the classroom 500.

Figure 38:
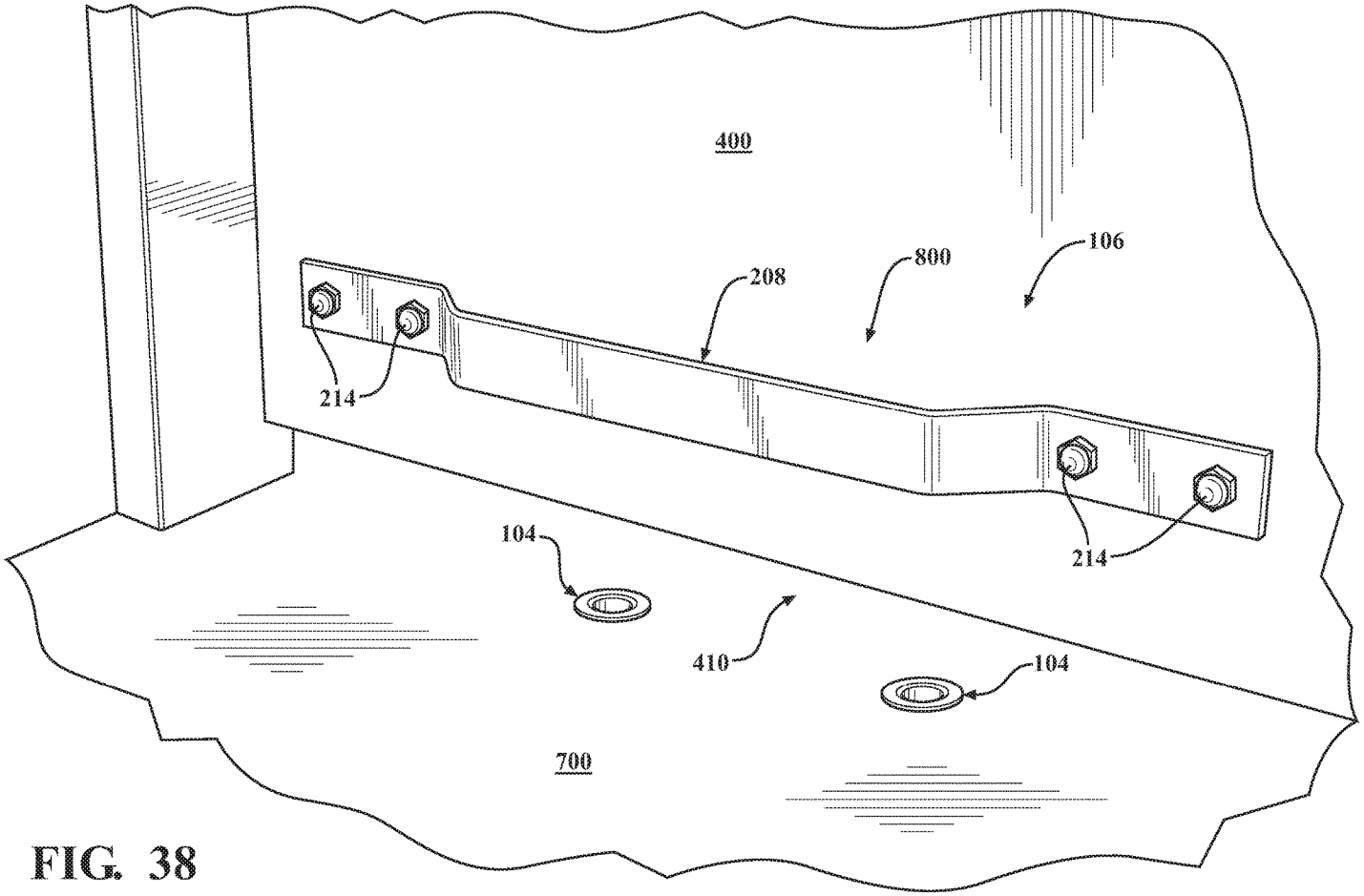
Figure 39:
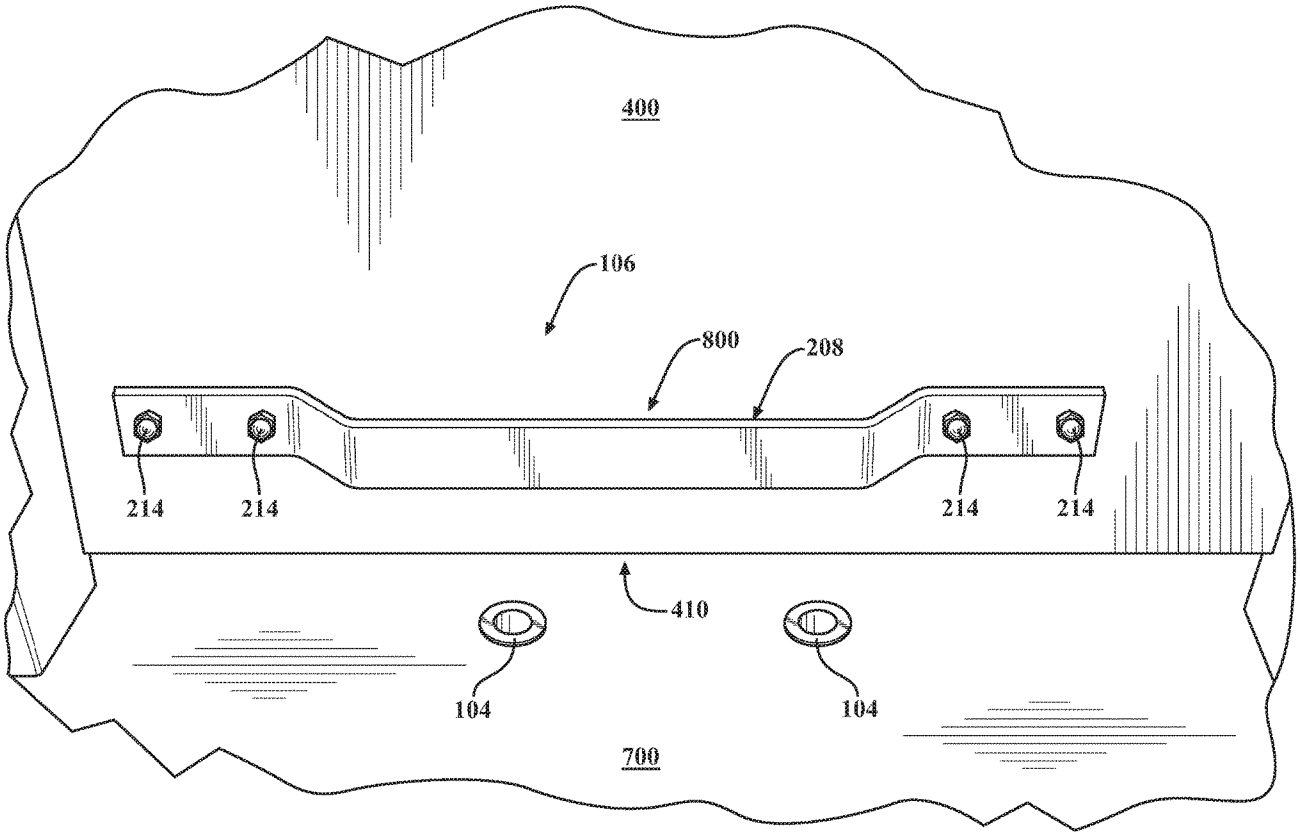

The strap plate 208 is then positioned to have the threaded portions 254 of the shank portions 248 of the bolts 212 be positioned through the apertures 232*a*, 234*a*, 234*b*, 232*b* thereof, with aperture 232*a* being in alignment with aperture 402*a*, aperture 234*a* being in alignment with aperture 404*a*, aperture 234*b* being in alignment with aperture 404*b*, and aperture 232*b* being in alignment with aperture 402*b*. The rear surface 218 of the end portions 228*a*, 228*b* thus are positioned against the side or surface of the door 400 which faces the classroom 500, as illustrated in FIGS. 38 and 39.

Nuts 214 are then threaded onto the threaded portions 254 of the shank portions 248 of the bolts 212 until the base portions 256 of the nuts 214 are tightly positioned against the front surface 216 of the end portions 228*a*, 228*b* of the strap plate 208. The attachment assembly 106 of the door security system 100 is thus fixedly secured to the door 400. When the attachment assembly 106 is fixedly secured to the door 400, a slot 800 is provided between the door 400 and the middle and connecting portions 226, 230*a*, 230*b* of the strap plate 208, as illustrated in FIGS. 38 and 39.

With the holes 702 formed and the sleeves 104 positioned therein, and when the attachment assembly 106 is secured to the door 400 (if door 400 is provided), further installation and operation of the door security system 100 may be performed when required. The security apparatus 102 is retained in the classroom 500, preferably in a location which is proximate to the door 300, 400, which is easily accessible, and which is in open view. For instance, one or more magnets may be provided along a wall of the classroom 500 proximate to the door 300, 400, for instance twelve (12) inches or less, and the security apparatus 102 may be secured to the magnets.

Figure 40:
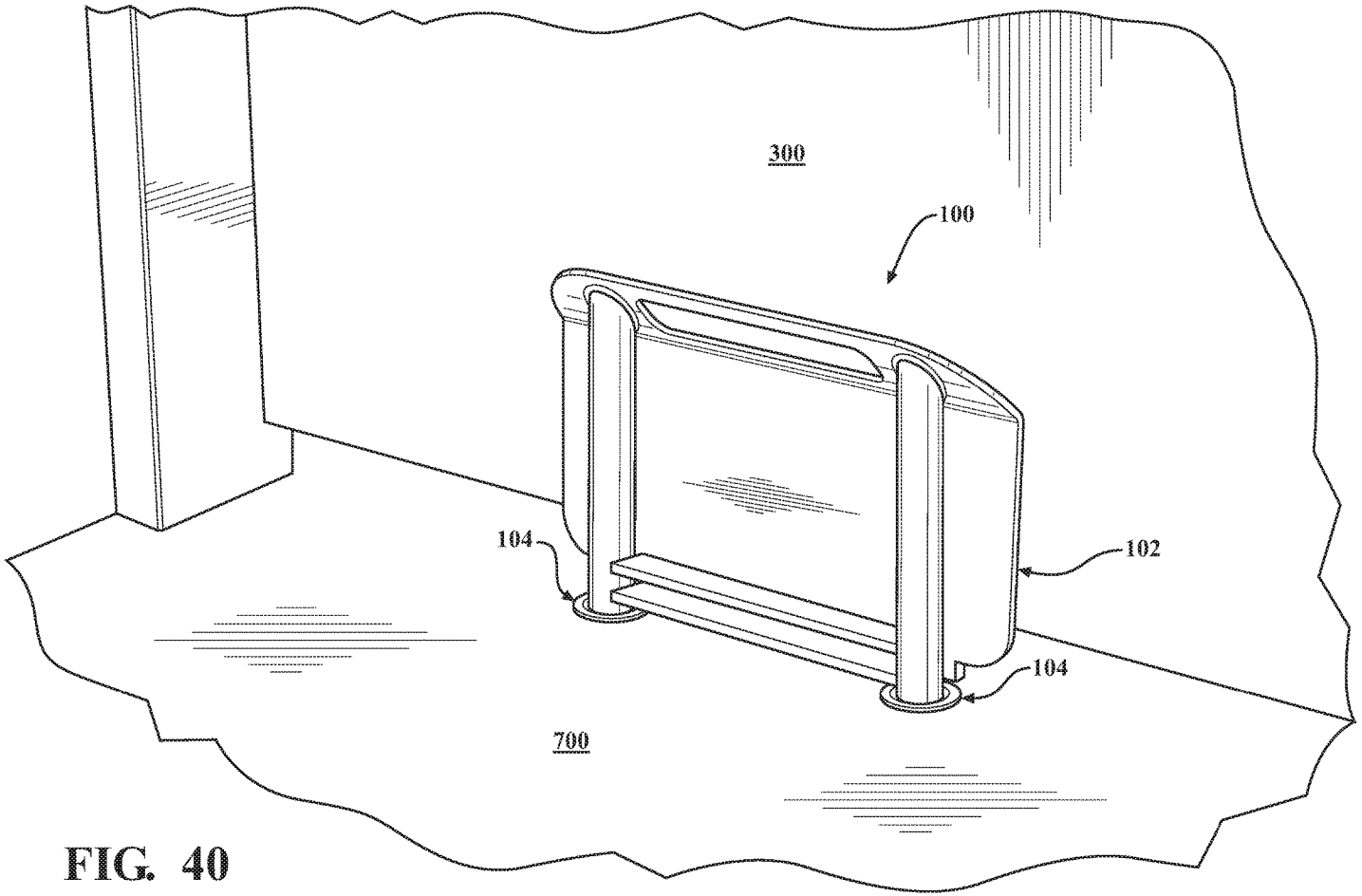
FIG. 40 illustrates the installation and operation of the door security system of the preferred embodiment of the invention in connection with an inwardly opening door.

Attention is directed to FIG. 40 in connection with a description of the further installation and operation of the door security system 100 in connection with door 300. If an unauthorized person has entered the school and one or more individuals located in the classroom 500 are alerted to, or otherwise become aware of the unauthorized person's presence in the school, the individual(s) may use the door security system 100 to try and prevent (or at least delay) the unauthorized person from entering the classroom 500 through the door 300. More specifically, an individual would locate the security apparatus 102 and bring it next to the door 300. The security apparatus 102 is easily handled due to the provision of the aperture 146 through the top portion 134 of the main plate 110, thus allowing the individual to insert his/her fingers through the aperture 146 to allow for the easy gripping of the security apparatus 102. Thus, the top portion 134 of the main plate 110 of the security apparatus 102 acts as a handle portion of the security apparatus. The security apparatus 102 preferably is also relatively light, preferably approximately five (5) pounds, such that any individual, even a young child, would be able to pick up and move the security apparatus 102.

The pins 112 of the security apparatus 102 are then positioned over, and in general alignment with, the holes 702/sleeves 104 in the floor 700. The rear surfaces 120, 138 of the middle and top portions 116, 134 of the security apparatus 102 are positioned to face the door 300, with the bottom portion 148 and the support plate 114 (and thus the opening to the channel 188 therebetween), being provided in a non-facing relation relative to the door 300.

The security apparatus 102 is then moved downwardly so that the generally domed portions 164, the generally conical portions 162, and portions of the generally cylindrical portions 160 of the pins 112 are inserted into the apertures 206 of the sleeves 104 (or into the holes 702 if the sleeves 104 are not provided, or are missing). The configuration of the conical and domed portions 162, 164 aids in the proper insertion of the pins 112 into the apertures 206 of the sleeve 104. The apertures 206 of the sleeve 104 are preferably slightly larger than the size of the pins 112, such that any type of side-to-side movement of the pins 112 is substantially prevented. The security apparatus 102 is moved downwardly until the bottom surface 152 of the bottom portion 148 comes into contact with the head portions 192 of the sleeves 104 (if the head portions 192 are not provided on the sleeves 104, or if the sleeves 104 are not provided at all, or are missing, the bottom surface 152 of the bottom portion 148 may contact the floor 700). Thus, the sleeves 104 act as a receiving assembly of the door security system 100, the pins 112 of the security apparatus 102 act as a floor engaging portion of the security apparatus 102, and the bottom portion 148 acts as a stop member of the security apparatus 102.

With the pins 112 in place, the rear surface 120 of the middle portion 116 of the security apparatus 102 is preferably positioned flush against, or in close proximity to, the door 300, as illustrated in FIG. 40. More specifically, a distance between the door 300 and the rear surface 120 of the middle portion 116 of the security apparatus 102 is approximately one-quarter of an inch (¼"), although the distance between the door 300 and the rear surface 120 of the middle portion 116 of the security apparatus 102 may be larger or smaller provided that the door security system 100 operates in the manner as described herein. The top portion 134 of the security apparatus 102 is provided at an angle relative to the middle portion 116 so as to provide the individual with adequate space to handle the security apparatus 102 proximate to the door 300.

As illustrated in FIG. 40, the security apparatus 102 is thus essentially engaged with the floor 700, as the pins 112 are anchored in the sleeves 104 positioned in the floor 700, and prevents the door 300 from being opened into the classroom 500. The middle portion 116 of the security apparatus 102 thus acts as a door blocking portion of the security apparatus 102. Thus, the door security system 100 will prevent, or at least substantially delay, the unauthorized person from gaining access to the classroom 500 through the door 300. When the unauthorized person is no longer a threat to the individual(s) within the classroom 500, the individual(s) may remove the security apparatus 102 from the sleeves 104 by grabbing the top portion 134 of the security apparatus 102, preferably utilizing the aperture 146 to aid in the gripping of the top portion 134, and pulling the security apparatus 102 straight upwardly. When the pins 112 are no longer positioned within the sleeves 104, the security apparatus 102 can be returned to its place of storage and the door 300 can be opened into the classroom 500.

Attention is directed to FIGS. 41-54 in connection with a description of the further installation and operation of the door security system 100 in connection with door 400. If an unauthorized person has entered the school and one or more individuals located in the classroom 500 are alerted to, or otherwise become aware of, the unauthorized person's presence in the school, the individual(s) may use the door security system 100 to try and prevent (or at least delay) the unauthorized person from entering the classroom 500 through the door 400. More specifically, an individual would locate the security apparatus 102 and bring it next to the door 400. The security apparatus 102 is easily handled due to the provision of the aperture 146 through the top portion of the main plate 110, thus allowing the individual to insert his/her fingers through the aperture 146 to allow for the easy gripping of the security apparatus 102. Thus, the top portion 134 of the main plate 110 of the security apparatus 102 acts as a handle portion of the security apparatus. The security apparatus 102 preferably is also relatively light, preferably approximately five (5) pounds, such that any individual, even a young child, would be able to pick up and move the security apparatus 102.

The pins 112 of the security apparatus 102 are then positioned over the slot 800 provided between the door 400 and the strap plate 208 of the attachment assembly 106. The pins 112 are further position over, and in general alignment with, the holes 702/sleeves 104 in the floor 700. The rear surfaces 120, 138 of the middle and top portions 116, 134 of the security apparatus 102 are positioned to face the door 400, with the bottom portion 148 and the support plate 114 (and thus the opening to the channel 188 therebetween), being provided in a non-facing relation relative to the door 400.

The security apparatus 102 is then moved downwardly so that the generally domed portions 164, the generally conical portions 162, and portions of the generally cylindrical portions 160 of the pins 112 are first inserted through the slot 800, and then inserted into the apertures 206 of the sleeves 104 (or into the holes 702 if the sleeves 104 are not provided, or are missing). The configuration of the conical and domed portions 162, 164 aids in the proper insertion of the pins 112 into the apertures 206 of the sleeve 104. The apertures 206 of the sleeve 104 are preferably slightly larger than the size of the pins 112, such that any type of side-to-side movement of the pins 112 is substantially prevented. The security apparatus 102 is moved downwardly until the bottom surface 152 of the bottom portion 148 comes into contact with the head portions 192 of the sleeves 104 (if the head portions 192 are not provided on the sleeves 104, or if the sleeves 104 are not provided at all, or are missing, the bottom surface 152 of the bottom portion 148 may contact the floor 700). Thus, the sleeves 104 act as a receiving assembly of the door security system 100, while the pins 112 of the security apparatus 102 act as a floor engaging portion of the security apparatus 102.

Figure 41:
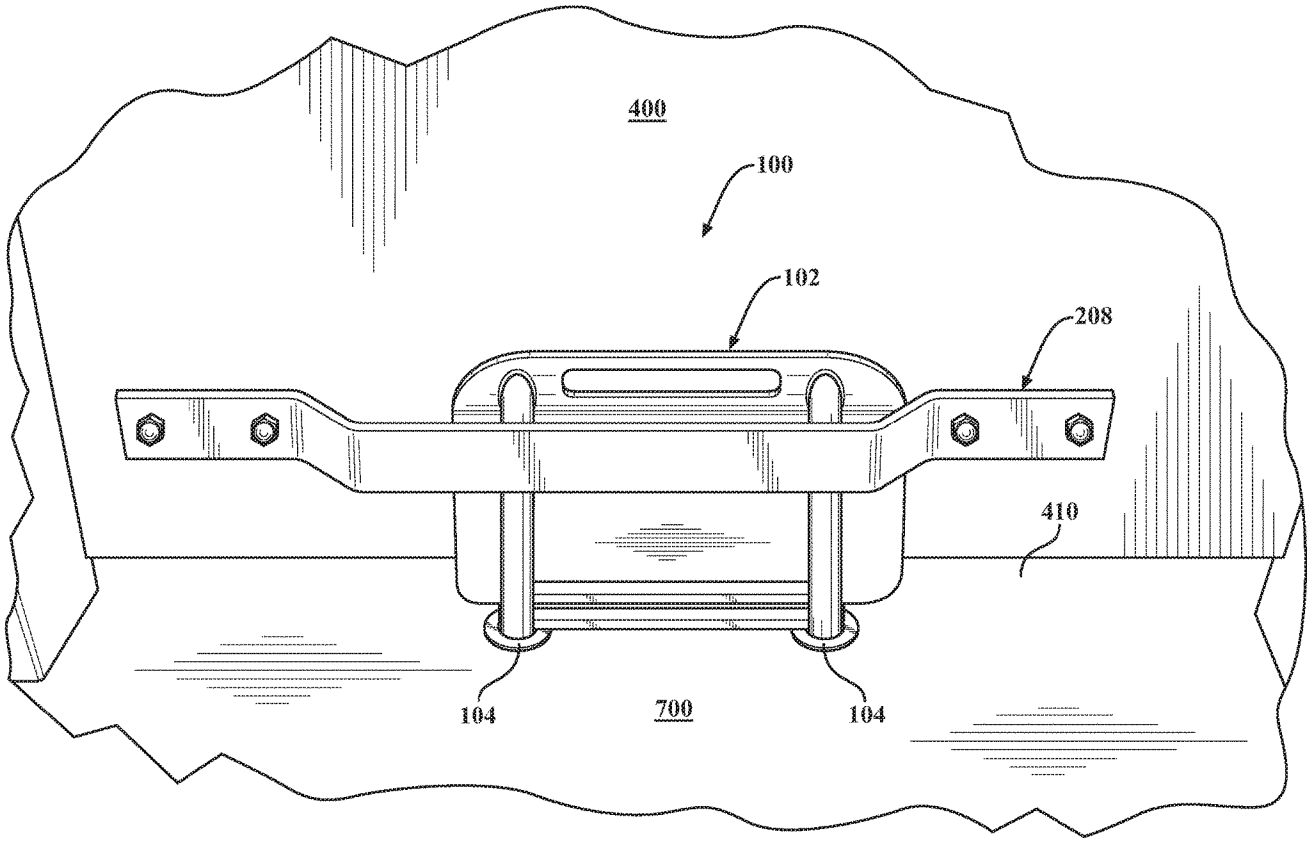
FIGS. 41-54 illustrate the installation and operation of the door security system of the preferred embodiment of the invention in connection with an outwardly opening door.
Figure 42:
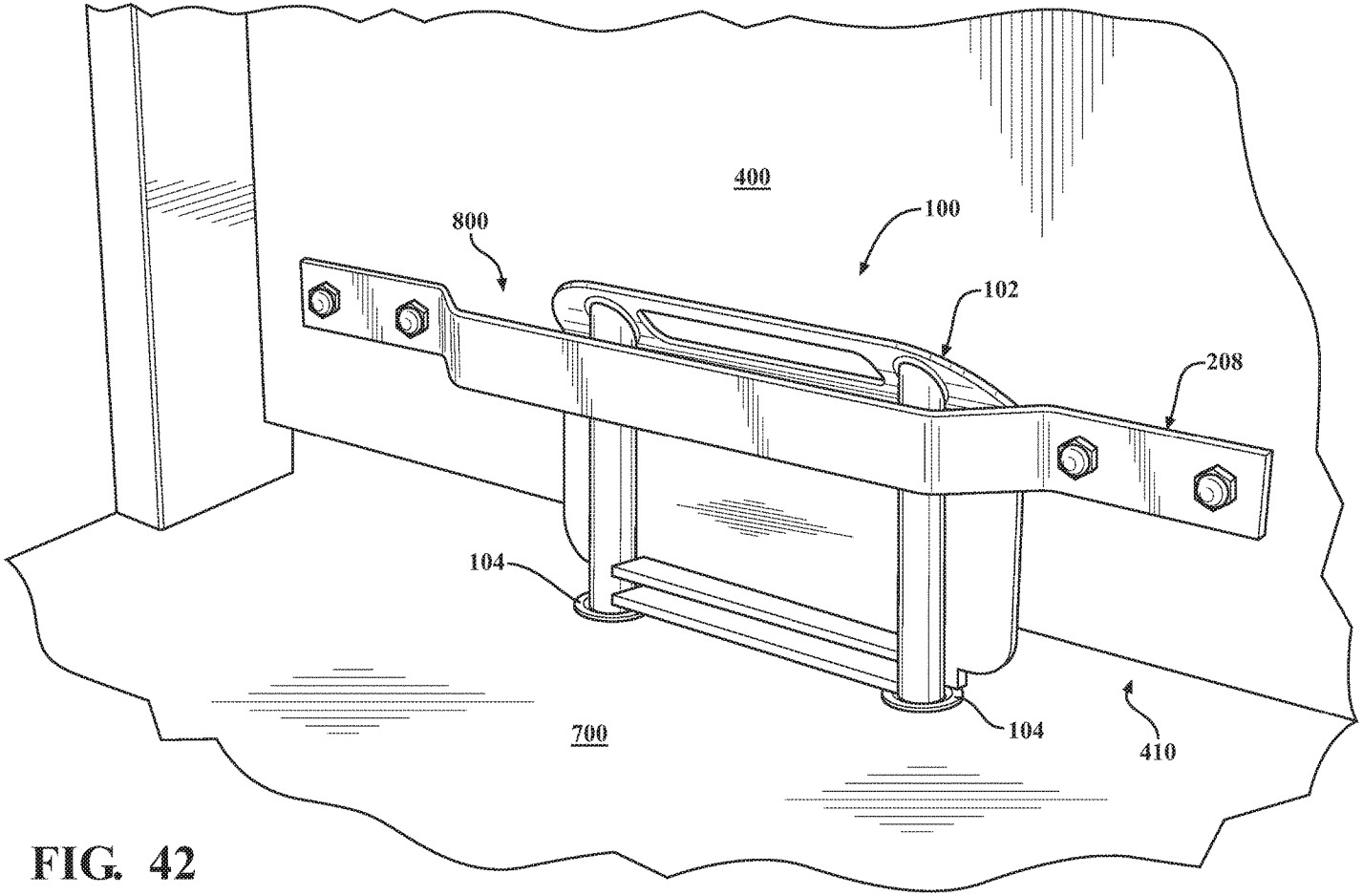

With the pins 112 in place, the cylindrical portions 160 of the pins 112 are positioned to rest against, or be in close proximity to, the rear surface 218 of the middle portion 226 of the strap plate 208 of the attachment assembly 106. The first side edge portion 128*b* of the side edge 126*b* of the middle portion 116 of the security apparatus 102 is positioned proximate to the connection of the connecting portion 130*b* and the end portion 128*b* of the strap plate 208 of the attachment assembly 106, while the first side edge portion 128*a* of the side edge 126*a* of the middle portion 116 of the security apparatus 102 is positioned distal to the connection of the connecting portion 130*a* and the end portion 128*a* of the strap plate 208 of the attachment assembly 106. Furthermore, the rear surface 120 of the middle portion 116 of the security apparatus 102 is preferably positioned flush against, or in close proximity to, the door 400, as illustrated in FIGS. 41 and 42. More specifically, a distance between the door 400 and the rear surface 120 of the middle portion 116 of the security apparatus 102 is approximately one-quarter of an inch (¼"), although the distance between the door 400 and the rear surface 120 of the middle portion 116 of the security apparatus 102 may be larger or smaller provided that the door security system 100 operates in the manner as described herein. The top portion 134 of the security apparatus 102 is provided at an angle relative to the middle portion 116 so as to provide the individual with adequate space to handle the security apparatus 102 proximate to the door 400. The top portion 134 is also preferably positioned above the strap plate 208.

As illustrated in FIGS. 41 and 42, the security apparatus 102 is thus essentially engaged with the floor 700, as the pins 112 are anchored in the sleeves 104 positioned in the floor 700, and captured between the strap plate 208 and the door 400, and thus prevents the door 400 from being opened into the hallway 600. The strap plate 208 of the attachment assembly 106 and the middle portion 116 of the security apparatus 102 thus act as door blocking portions of the security apparatus 102. Thus, the door security system 100 will prevent, or at least substantially delay, the unauthorized person from gaining access to the classroom 500 through the door 400. When the unauthorized person is no longer a threat to the individual(s) within the classroom 500, the individual(s) may remove the security apparatus 102 from the sleeves 104 and from being captured by the attachment assembly 106 by grabbing the top portion 134 of the security apparatus 102, preferably utilizing the aperture 146 to aid in the gripping of the top portion 134, and pulling the security apparatus 102 straight upwardly. When the pins 112 are no longer positioned within the sleeves 104 or within the slot 800, the security apparatus 102 can be returned to its place of storage and the door 400 can be opened into the hallway 600.

However, if, for whatever reason, the individual(s) within the classroom 500 cannot or will not remove the security apparatus 102, and if an individual in the hallway 600 needs to enter the classroom 500 (such as a school administrator or emergency personnel, e.g., a police officer or a fireman), the release mechanism 108 of the door security system 100 can be utilized by this individual to unanchor and disengage the security apparatus 102 from the floor 700 within the classroom 500, as illustrated in FIGS. 43-54. Unlike the security apparatus 102, the release mechanism 108 is preferably stored in secured location remote from the door 400 to the classroom 500, such as in an administrator's office, in a police car, or in a fire truck.

Figure 43:
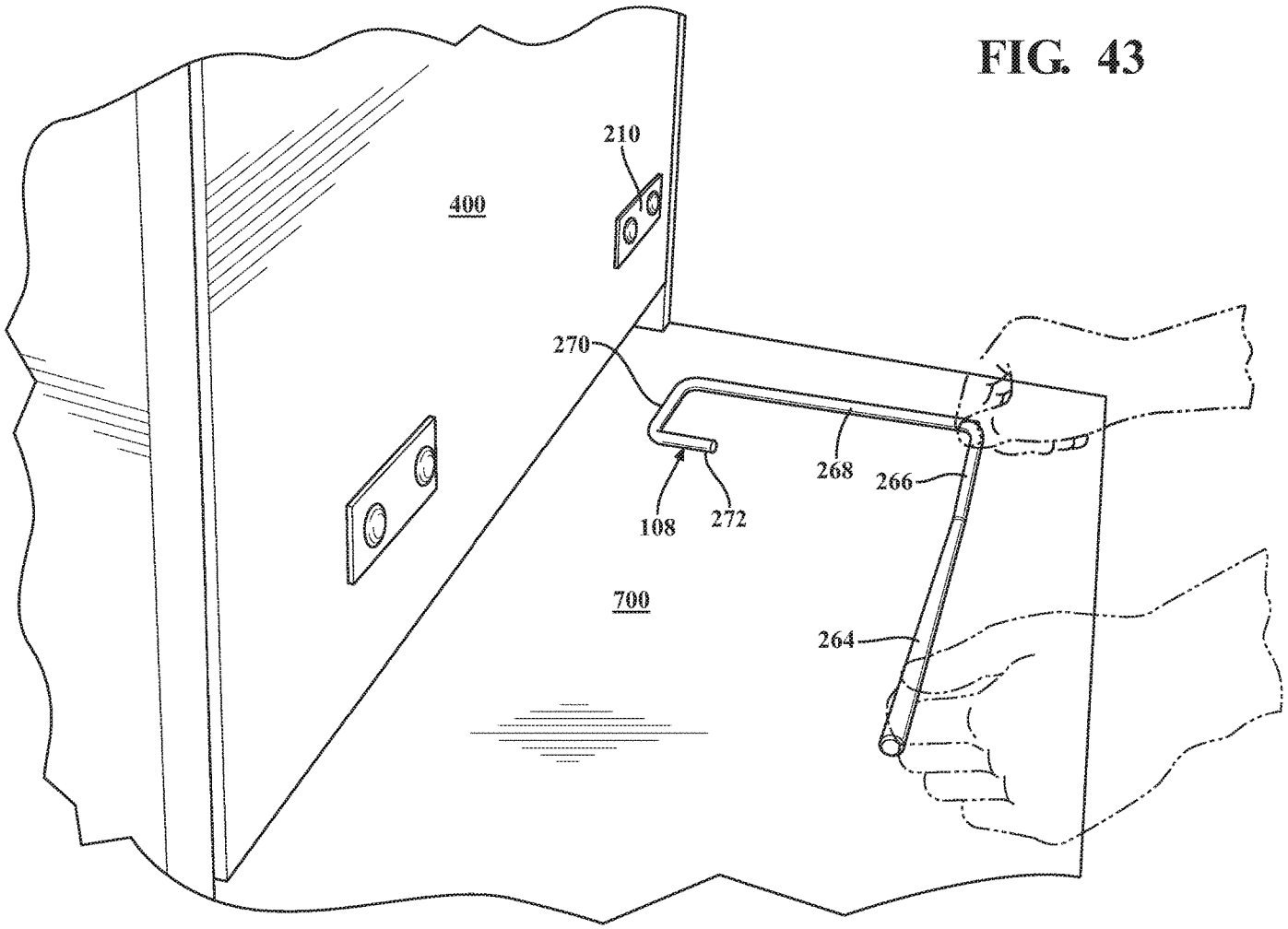

As illustrated in FIG. 43, the individual located in the hallway 600 first positions the release mechanism 108 on the floor 700 of the hallway 600 proximate to the door 400 such that the second, third, fourth, and fifth portions 266, 268, 270, 272 of the release mechanism 108 are positioned flat against the floor 700, and such that the first portion 264 is angled upwardly from the floor 700. The fourth portion 270 of the release mechanism 108 is positioned most proximate to the door 400, preferably in a parallel relationship with the door 400, and in general alignment with the washer plate 210 positioned at the right side of the door 400. As will become apparent herein, the first and second portions 264, 266 of the release mechanism 108 act as a handle portion of the release mechanism 108, while the third, fourth and fifth portions 268, 270, 272 of the release mechanism 108 act as a security apparatus engaging portion of the release mechanism 108.

Figure 44:
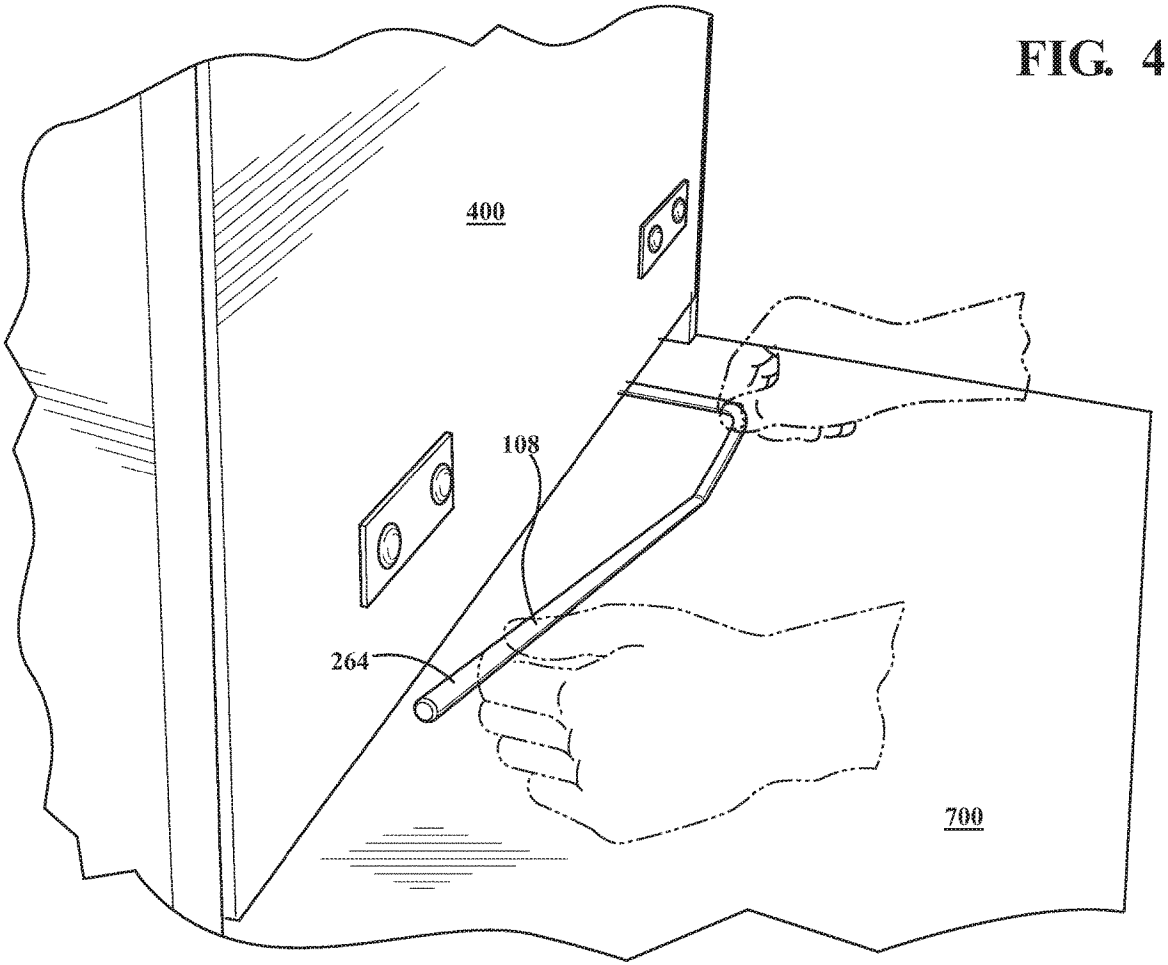
Figure 45:
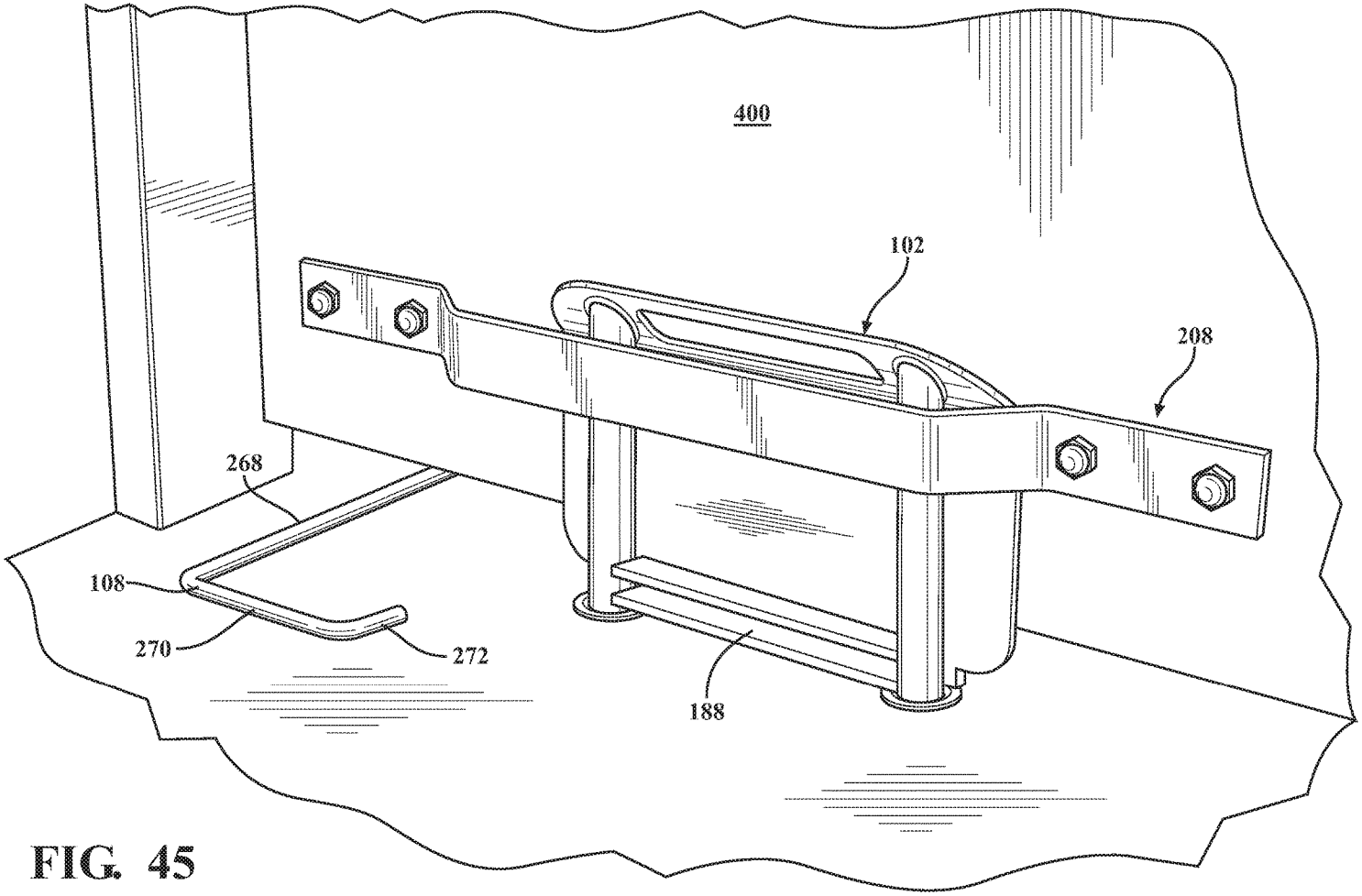

As illustrated in FIGS. 44 and 45, the release mechanism 108 is then moved forward, under the door 400 and through the slot 800 until the first and second portions 264, 266 of the release mechanism 108 are positioned proximate to the door 400 (see FIG. 44), and until the fourth and fifth portions 270, 272 of the release mechanism 108 are positioned further into the classroom 500 than is the security apparatus 102 (see FIG. 45).

Figure 46:
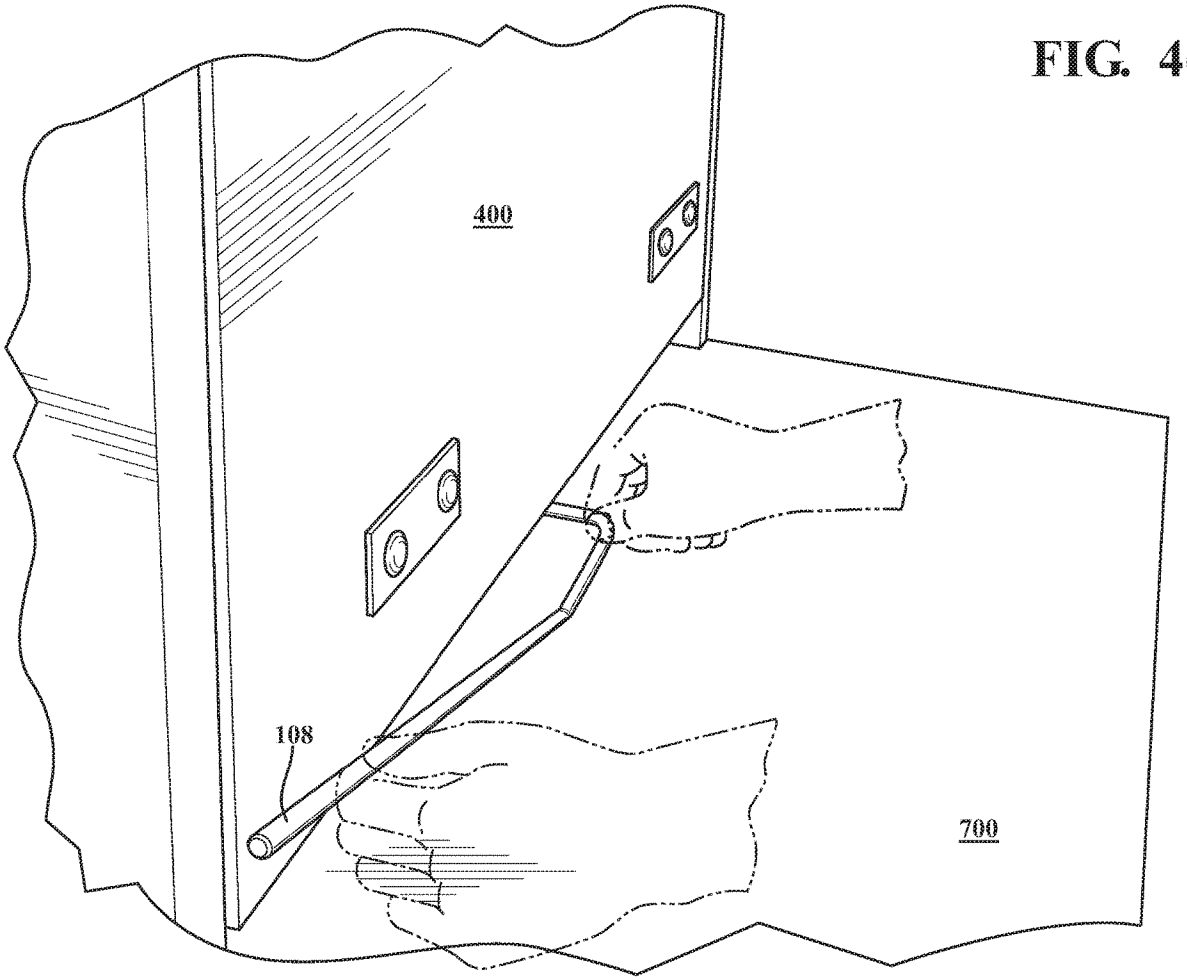
Figure 47:
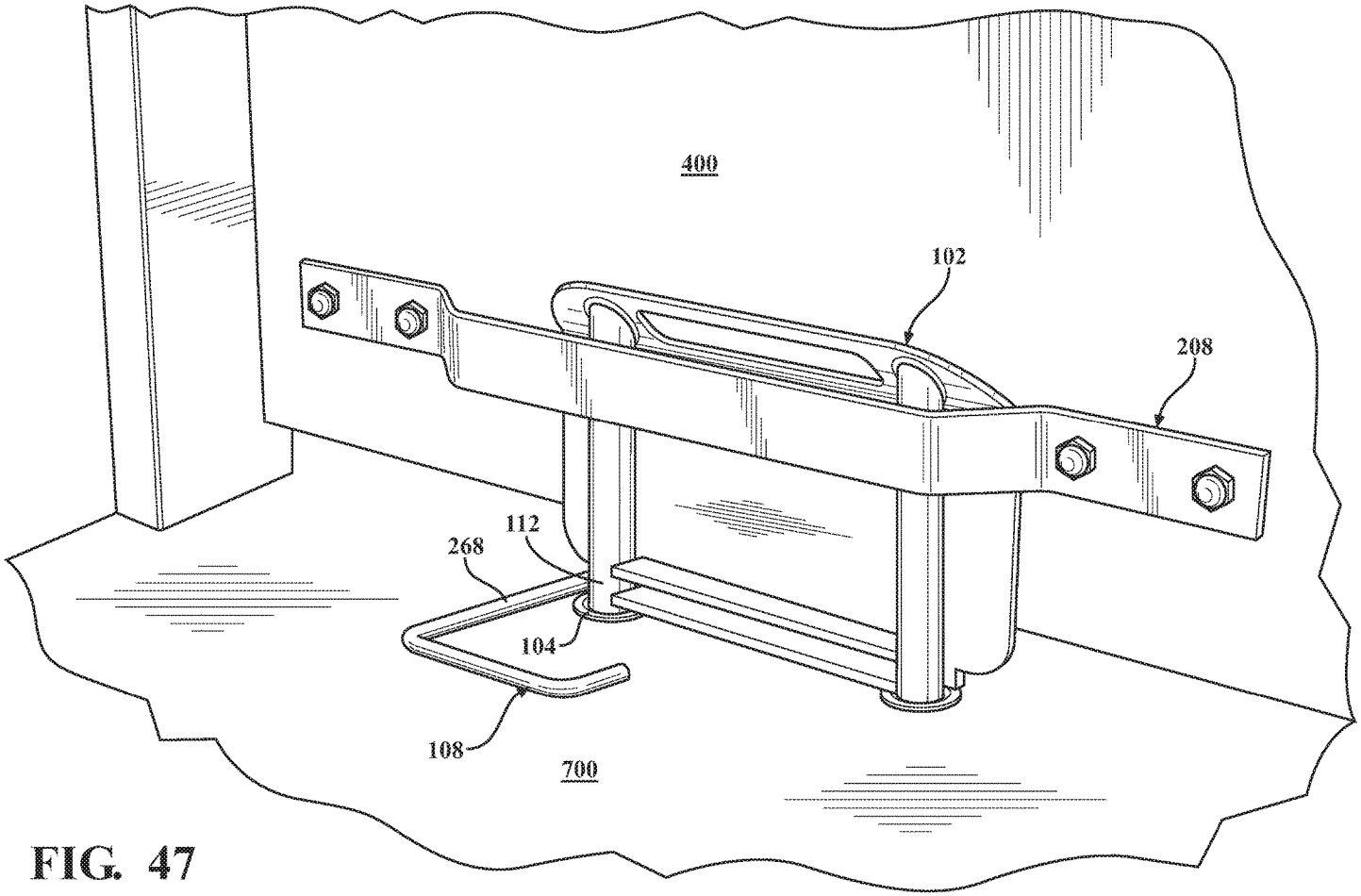

As illustrated in FIGS. 46 and 47, the release mechanism 108 is then moved to the left until the third portion 268 of the release mechanism 108 abuts against one or both of the leftmost pin 112 of the security apparatus 102 and the head portion 192 of the leftmost sleeve 104 (when viewed from the classroom 500, as shown in FIG. 47).

Figure 48:
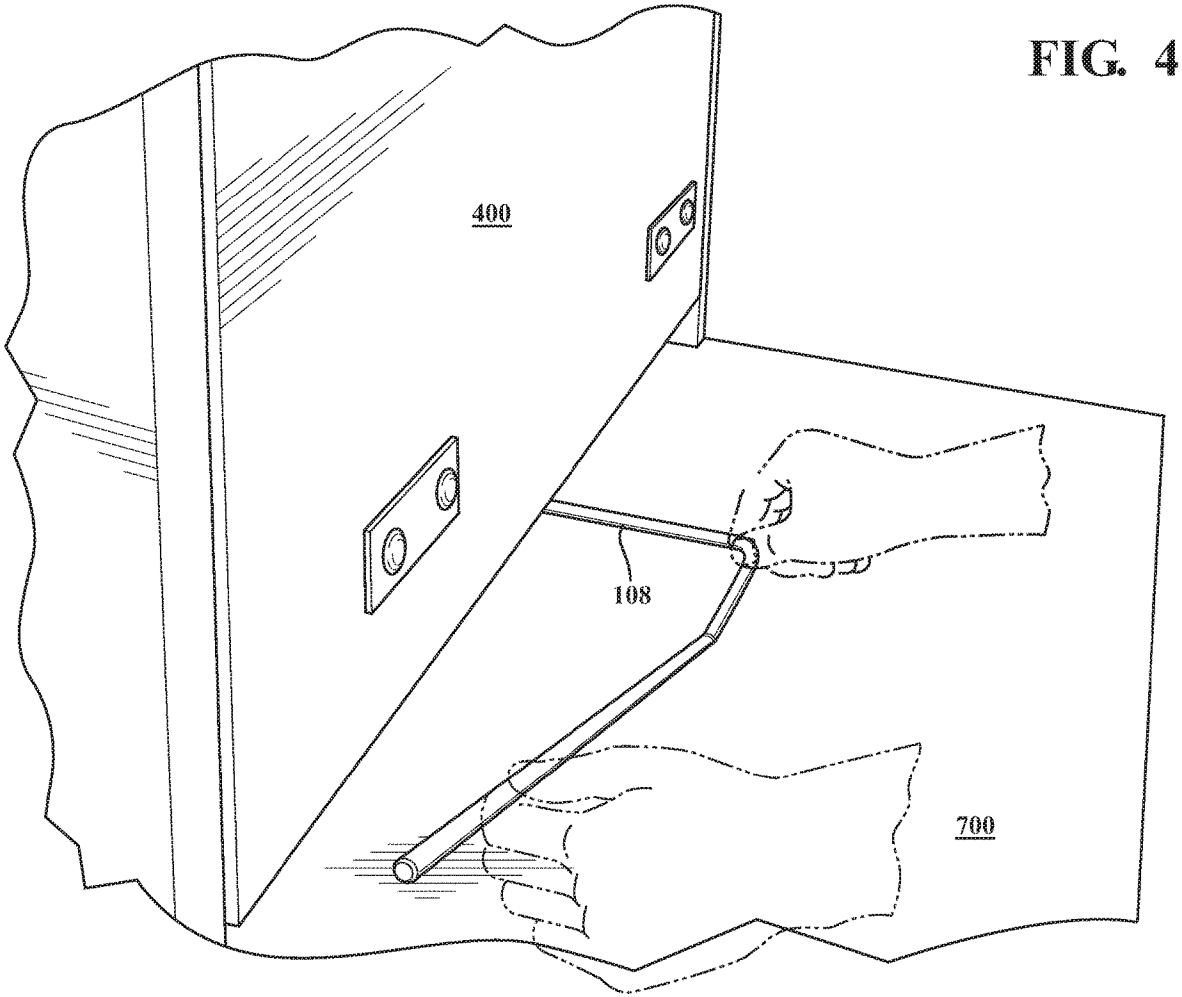
Figure 49:
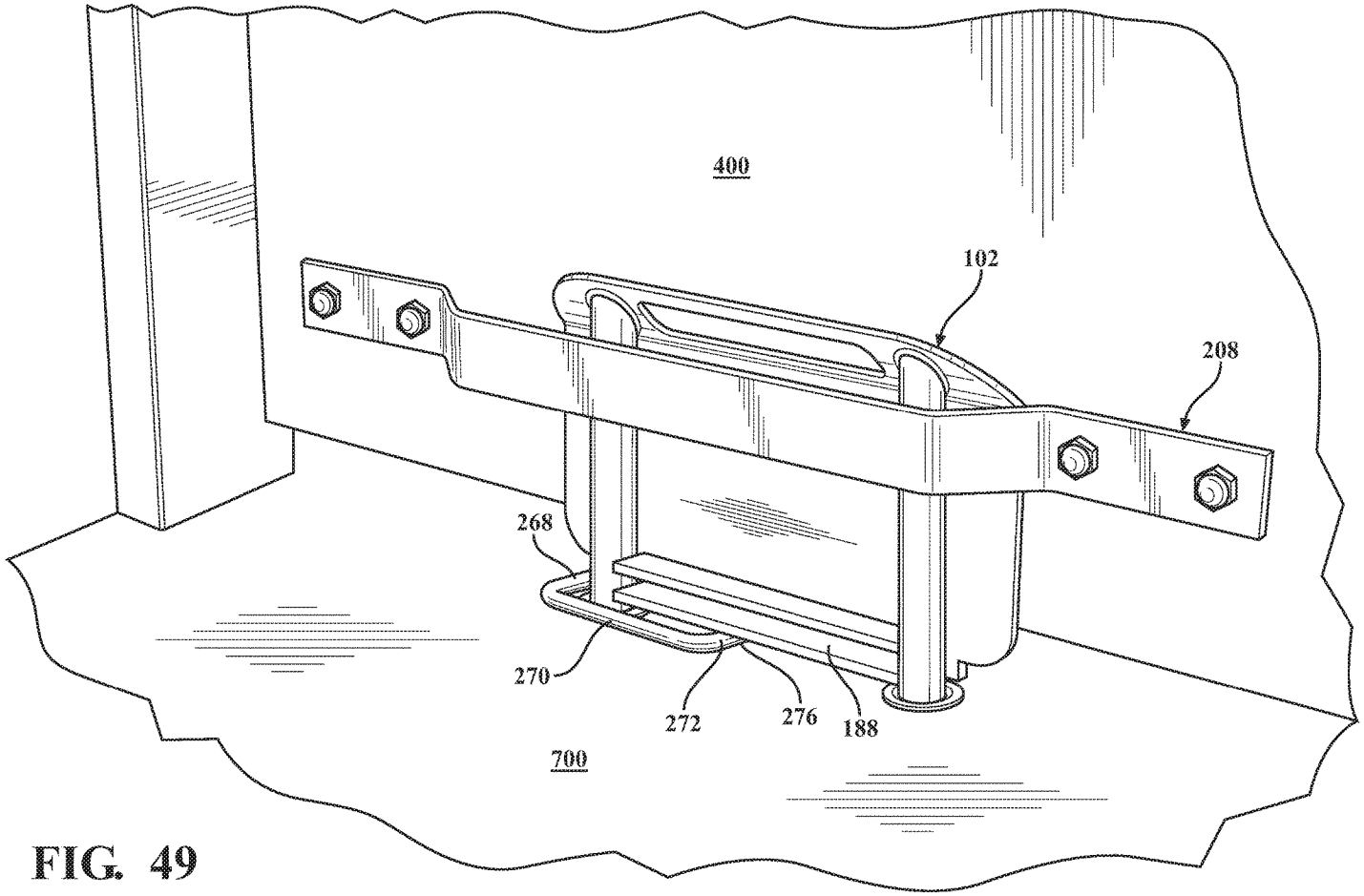

As illustrated in FIGS. 48 and 49, the release mechanism 108 is then moved back toward the individual in the hallway 600 until a portion of the fifth portion 272 of the release mechanism 108, including at least the free end 276 thereof, is positioned within the channel 188 of the security apparatus 102, between the bottom portion 148 of the main plate 110 and the support plate 114.

Figure 50:
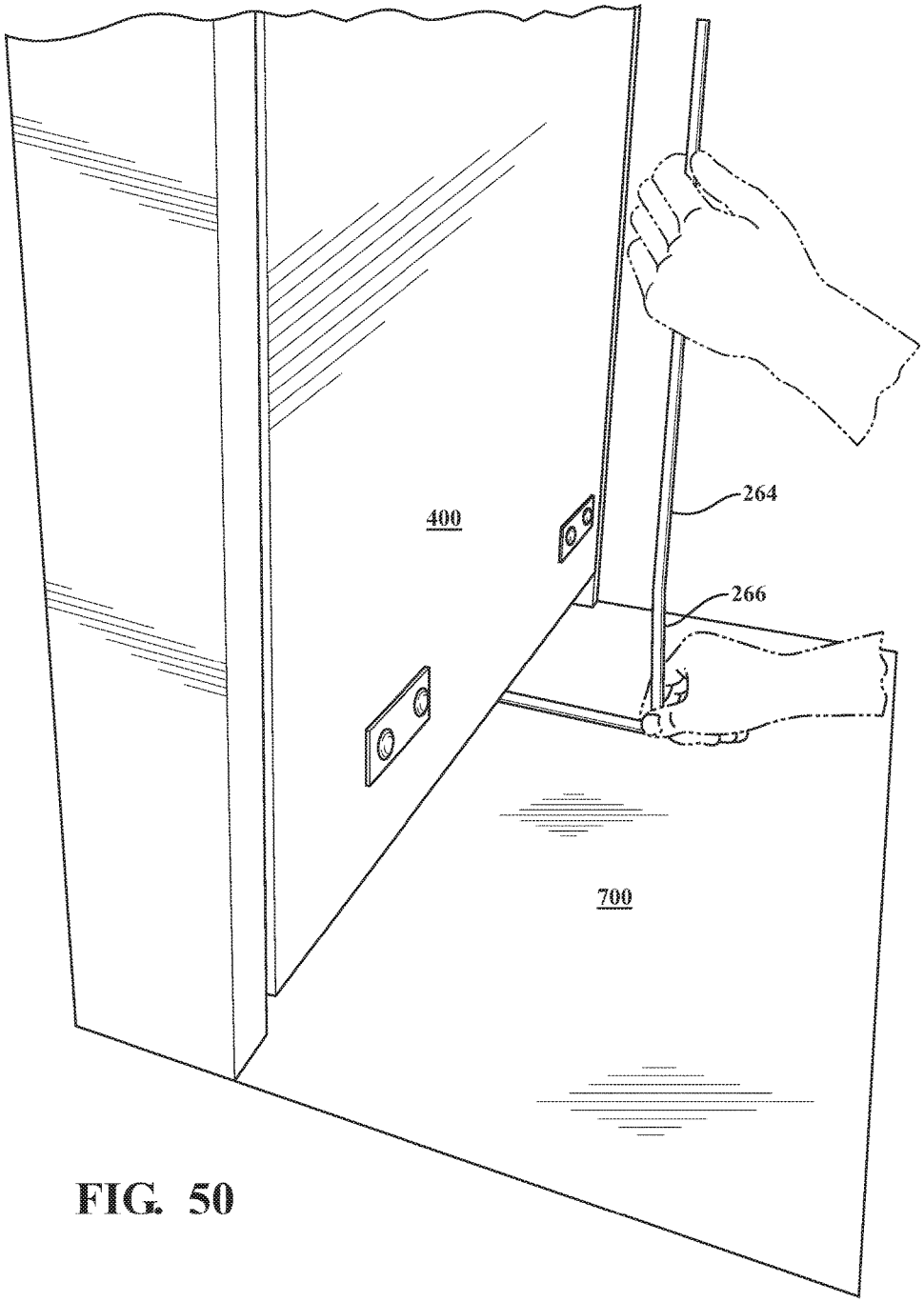
Figure 51:
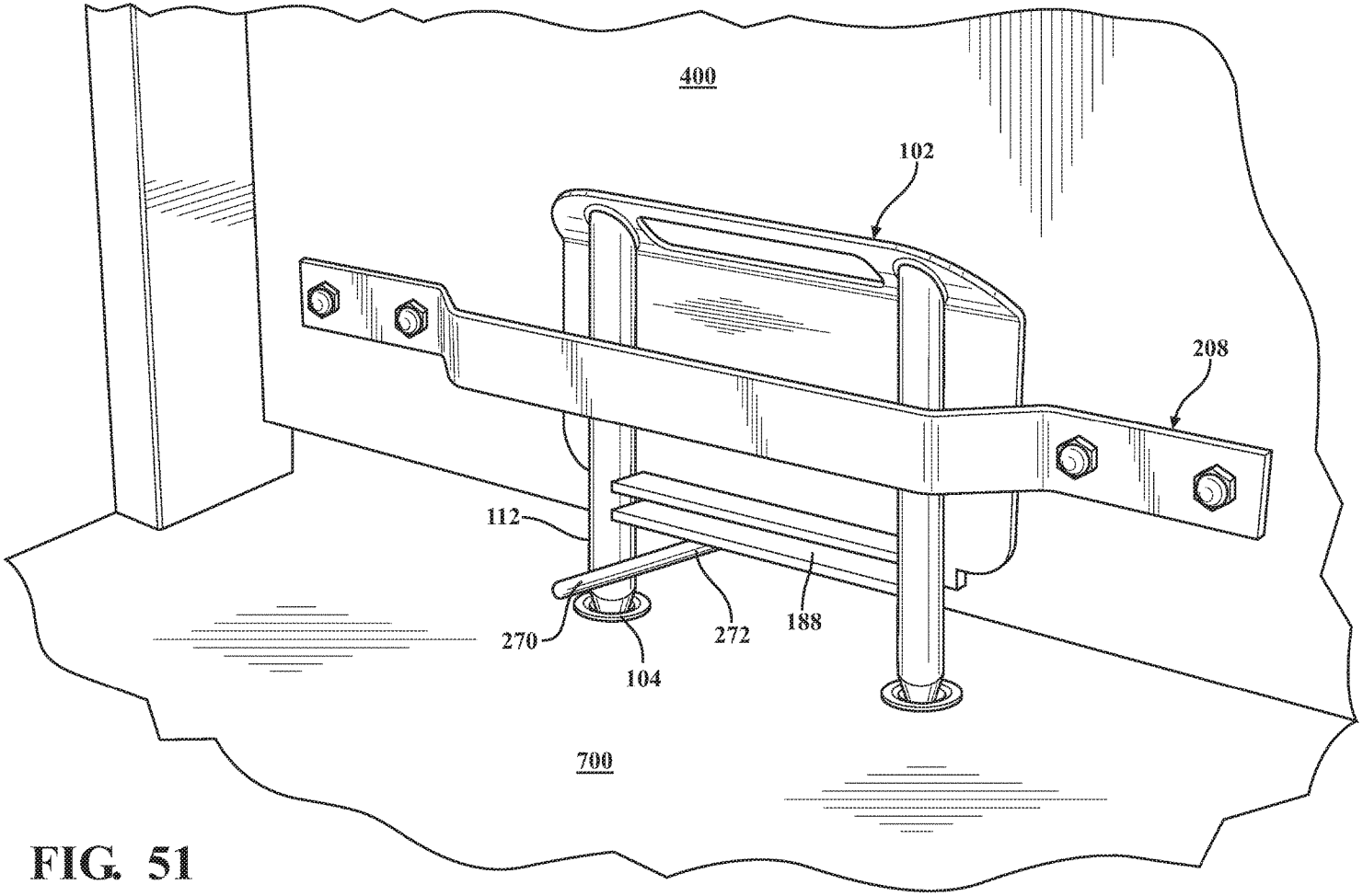

As illustrated in FIGS. 50 and 51, the release mechanism 108 is then rotated to the right (when viewed from the hallway 600, as shown in FIG. 50) by the individual in the hallway 600 so that the second portion 266 of the release mechanism 108 comes to a position where it is substantially perpendicular to the floor 700 (see FIG. 50). This rotational movement of the release mechanism 108 also causes the fourth and fifth portions 270, 272 of the release mechanism 108 to likewise rotate. As a portion of the fifth portion 272 is positioned in the channel 188 between the bottom portion 148 of the main plate 110 and the support plate 114, the fifth portion 272 engages the support plate 114 to lift the security apparatus 102 upward, thereby lifting the pins 112 out of the sleeves 104. As the fifth portion 272 lifts the security apparatus 102, the fifth portion 272 slides to the left within the channel 188 (as viewed in FIG. 51).

Figure 52:
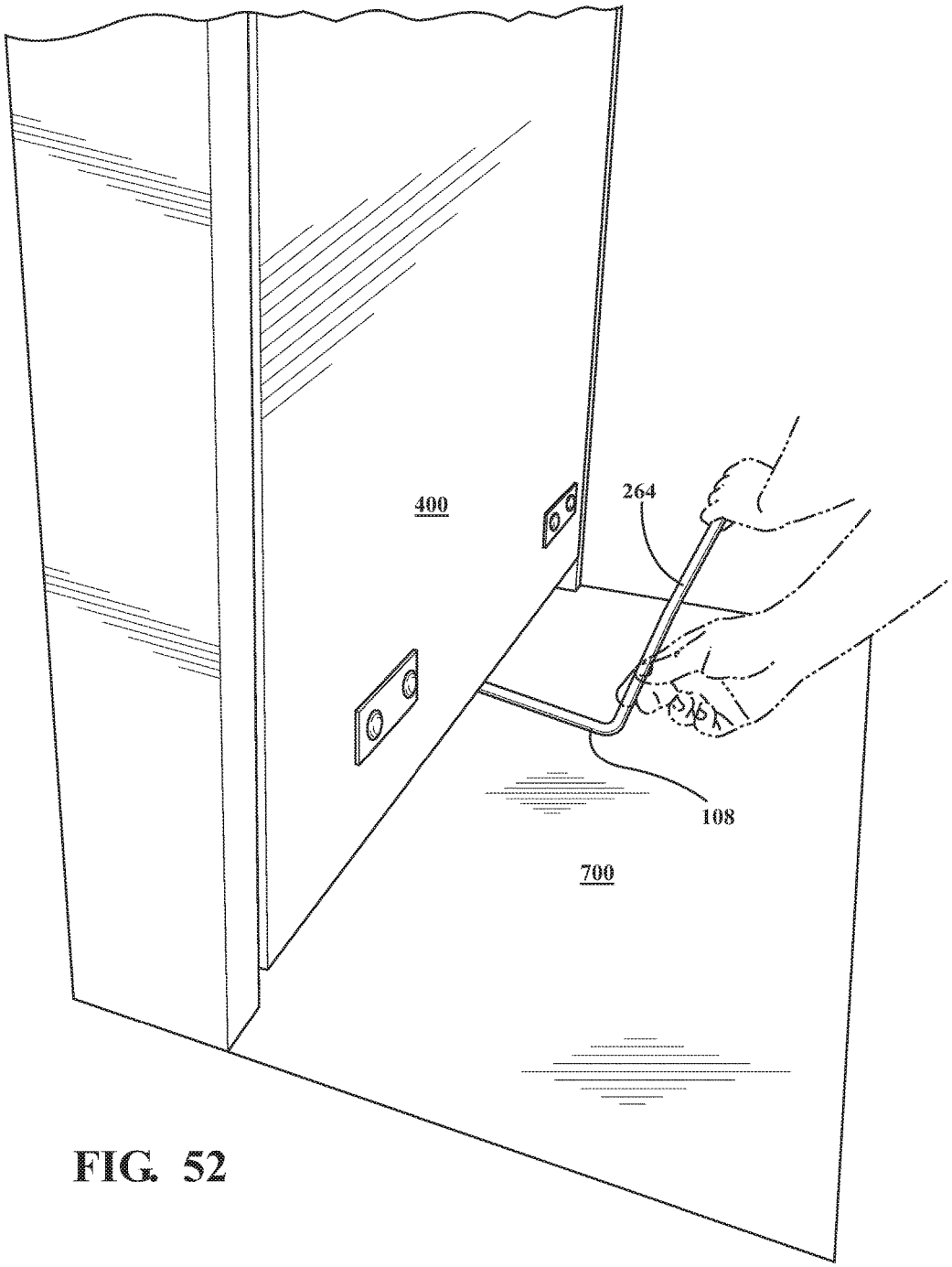
Figure 53:
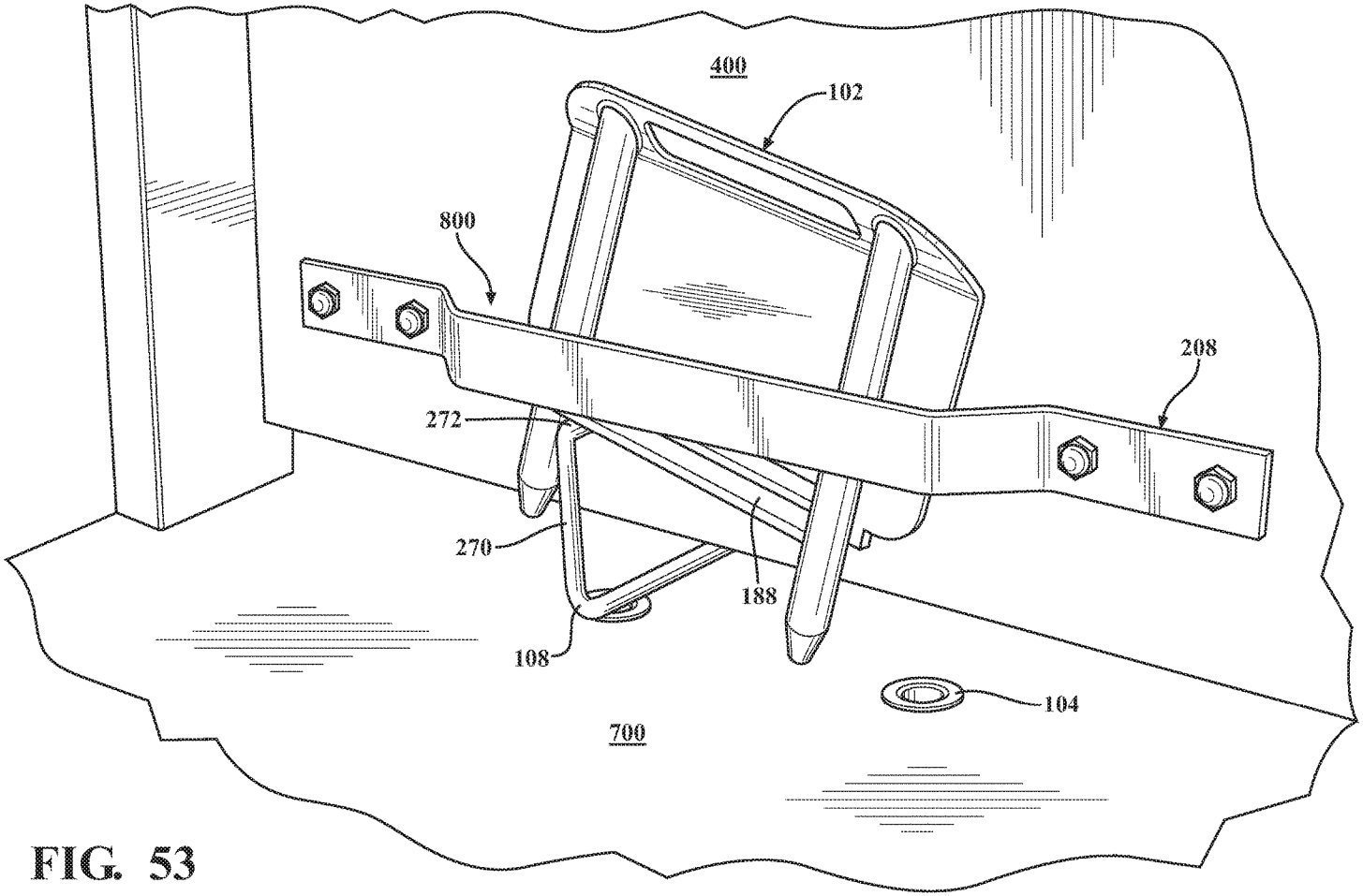

As illustrated in FIGS. 52 and 53, continued rotation of the release mechanism to the right (as viewed from the hallway 600, as shown in FIG. 52) causes the first portion 264 of the release mechanism 108 to be positioned in a generally parallel positioned relative to, but offset from, the floor 700. Such continued rotation causes the fourth portion 270 of the release mechanism 108 to come to a position which is substantially perpendicular to the floor 700, and causes the fifth portion 272 of the release mechanism 108 to further slide to the left in the channel 188 (as viewed from the classroom 500, as shown in FIG. 53), thereby unanchoring the pins 112 from the sleeves 104 and moving the security apparatus 102 within the slot 800 to the left, such that the pins 112 are no longer aligned with the sleeves 104 (as viewed from the classroom 500, as shown in FIG. 53). The strap plate 208 is preferably positioned at a height above the door 400 so as not to interfere with the rotational movements of the release mechanism 108.

Figure 54:
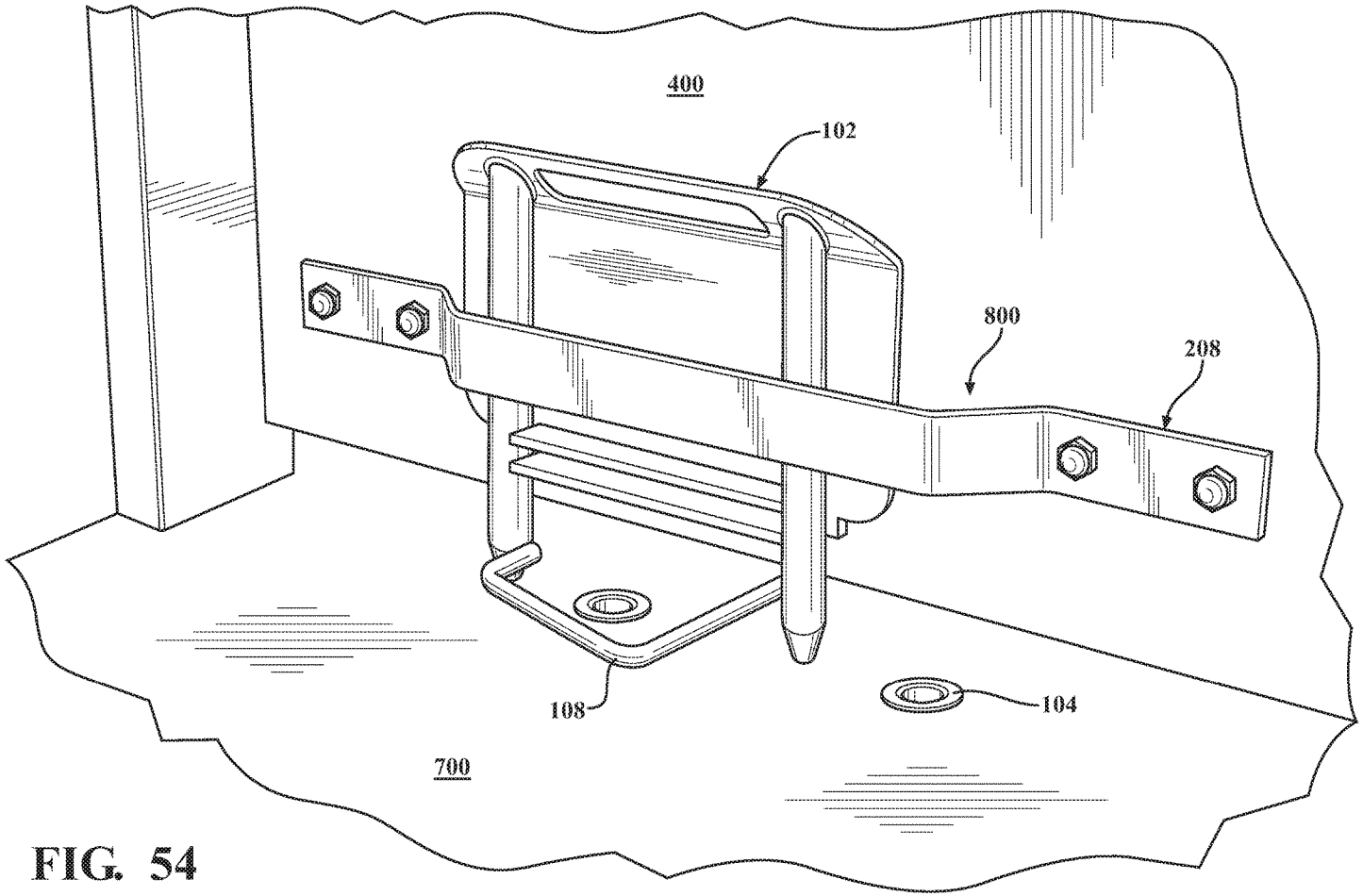

As illustrated in FIG. 54, once the security apparatus 102 is unanchored from the floor 700 and the pins 112 are moved out of alignment with the sleeves 104, the release mechanism 108 can be moved forwardly by the individual in the hallway 600 so as to disengage the fifth portion 272 of the release mechanism 108 from within the channel 188 of the security apparatus 102. The domed portions 164 of the pins 112 of the security apparatus 102 will then rest on the floor 700, but the security apparatus 102 will be maintained in a standing position as it will remain captured within the slot 800 between the door 400 and the strap plate 208. The release mechanism 108 can then be pulled by the individual in the hallway 600 so that the release mechanism 108 moves between the pins 112 of the security apparatus 102 and through the slot 410 between the door 400 and the floor 700. As the security apparatus 102 is no longer anchored in the floor 700, the door 400 can then be opened into the hallway 600.

It is to be understood that the release mechanism 108 of the door security system 100 could also be utilized to unanchor the security apparatus 102 from the floor 700 when the security apparatus 102 is preventing the opening of door 300 into the classroom 500. The manner in which the release mechanism 108 would unanchor the security apparatus 102 in relation to door 300 would be identical to that in relation to door 400.

Thus, it is to be understood that the security apparatus 102 of the door security system 100 can be anchored within the sleeves 104 positioned in the floor 700 (and in the slot 800 in the case of an outwardly opening door 400) in both a quick and easy manner, even by a small child, in the event where one or more unauthorized individuals has entered the facility in which the room 500 is provided, e.g., in the event of a lockdown or emergency in a school. The door security system 100 thus does not require the use of keys or alarms, or the execution of complicated procedures—the security apparatus 102 can just be dropped into place to lock the door 300, 400. From within the room 500, the security apparatus 102 can be quickly and easily unanchored from the floor 700 by simply pulling upward on the security apparatus 102. Conversely, from outside of the room 500, the security apparatus 102 can also be quickly and easily unanchored from the floor 700 through quick use of the release mechanism 108.

It is to be recognized that the door security system 100 is suitable for use in a number of different environments, including schools, offices and residences. With regard to schools and offices, these environments are typically subject to jurisdictional fire codes. While fire codes vary from jurisdiction to jurisdiction, unlike many other types of door security systems, the door security system 100 of the present invention has been found to comply with a number of different jurisdictional fire codes as the door security system 100 can be disengaged and removed from outside the room 500 in which it is installed.

The door security system 100 also provides significant strength improvements as compared to other prior art door security systems. As stated, the pins 112 are preferably formed of solid steel and are each designed to provide 8,000 pounds per square inch ("PSI") of tensile strength. Thus, each security apparatus 102, which has two pins 112, provides 16,000 PSI of tensile strength toward the prevention of the door 300, 400 being opened.

Furthermore, the door security system 100 when not in use (e.g., with only the sleeves 104 and attachment assembly 106 in place), poses no tripping or other hazards.

The door security system 100 may also lead to lower insurance premiums for environments where the door security system 100 is installed/utilized.

While not presently illustrated, if desired, the sleeves 104 could be outfitted with some type of cover so as to prevent dirt or other objects from falling into the apertures 206 of the sleeves 104. The covers could be of a removable/reinstallable type, or the covers could be provided in a manner where, if the security apparatus 102 is to be used, the pins 112 of the security apparatus 102 could essentially puncture through the covers, with the covers "breaking away", thereby allowing the pins 112 to move into their desired position within the apertures 206 of the sleeves 104.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosed embodiments of the invention and does not pose a limitation on the scope of the invention unless otherwise claimed. No language in the specification should be construed as indicating any non-claimed element as essential to the practice of the invention. It is further to be understood that the drawings are not necessarily drawn to scale.

Preferred embodiments of this invention are described herein, including the best mode known to the inventor for carrying out the invention. It should be understood that the illustrated embodiments are exemplary only, and should not be taken as limiting the scope of the invention.

The invention is claimed as follows:

1. A door security system configured for use in connection with a door, the door security system comprising:

a security apparatus comprising a floor engaging portion and a door blocking portion, the security apparatus being provided in a first space adjacent to a first side of the door, the door blocking portion configured to block the door from opening into the first space, the floor engaging portion configured to engage a floor provided in the first space in a manner which retains the security apparatus in place relative to the floor, the floor extending into the first space and a second space; and a release mechanism comprising a handle portion and a security apparatus engaging portion, the handle portion being configured to be manipulated by a user in the second space adjacent to a second side of the door, the security apparatus engaging portion being connected to the handle portion and configured to be extended by the user into the first space through a slot provided between a bottom of the door and the floor, the handle portion configured to be manipulated by the user to cause the security apparatus engaging portion to engage the security apparatus in a manner which causes the floor engaging portion to disengage from the floor such that the door is no longer blocked from opening into the first space.

2. The door security system as defined in claim 1, further comprising a receiving assembly, the receiving assembly being provided in the floor provided in the first space, the receiving assembly configured to receive the floor engaging portion of the security apparatus therein, thereby allowing the floor engaging portion to engage the floor provided in the first space.

3. The door security system as defined in claim 1, further comprising an attachment assembly, the attachment assembly configured to be secured to the door and to provide a slot between the first side of the door and the attachment assembly, the door blocking portion of the security apparatus configured to be positioned within the slot when the floor engaging portion of the security apparatus is engaged with the floor, the attachment assembly configured to block the door from opening into the second space.

4. The door security system as defined in claim 1, wherein the security apparatus comprises a handle portion, the handle portion being connected to the door blocking portion of the security apparatus.

5. A door security system comprising:

a security apparatus comprising a first portion which is configured to block a door from being opened into a first space, and a second portion which is configured to engage a floor inside the first space, the first portion comprising a door facing surface and a first space facing surface, the second portion comprising a pair of pins which are permanently secured to the first space facing surface of the first portion and which extend below the first portion to engage the floor inside the first space, whereby when the pair of pins are engaged with the floor, the security apparatus blocks the door from opening into the first space; and, wherein the first portion includes a floor stop member which extends inwardly from the first space facing surface, and away from the door facing surface, the floor stop member being positioned between the pair of pins.

6. The door security system as defined in claim 5, wherein the security apparatus further comprises a support plate which is secured to the first space facing surface and which extends inwardly from the first space facing surface, and away from the door facing surface, the support plate being positioned between the pair of pins, the support plate being positioned above the floor stop member such that a channel is defined between the support plate and the floor stop member.

7. The door security system as defined in claim 6, wherein the floor extends into the first space and a second space, the system further comprising a release mechanism, the release mechanism configured to be manipulated by a user from the second space which is provided on an opposite side of the door from the first space, the release mechanism configured to be extended by the user into the first space through a slot provided between the bottom of the door and the floor so as to be engaged within the channel of the security apparatus to disengage the pair of pins of the security apparatus from the floor such that the door is no longer blocked from opening into the first space.

8. The door security system as defined in claim 5, further comprising a pair of sleeves which each have an aperture provided therethrough, each sleeve being configured to be positioned within a corresponding hole formed in the floor of the first space, each sleeve being configured to receive a portion of a corresponding one of the pair of pins therein, thereby engaging the pair of pins with the floor.

9. The door security system as defined in claim 5, wherein the security apparatus further comprises a third portion which is secured to the first portion, the third portion having an aperture provided therethrough such that the third portion is configured to act as a handle portion of the security apparatus, each pin being secured to the third portion, the aperture being provided between the pins.

10. The door security system as defined in claim 5, wherein the security apparatus further comprises a third portion which is secured to the first portion, the third portion having an aperture provided therethrough such that the third portion is configured to act as a handle portion of the security apparatus.

11. The door security system as defined in claim 10, wherein the third portion extends from a top of the first portion in an upward and inward manner from the first space facing surface, and away from the door facing surface.

12. A door security system comprising:

a security apparatus comprising a first portion which is configured to block a door from being opened into a first space, and a second portion which is configured to engage a floor inside the first space, the first portion comprising a door facing surface and a first space facing surface, the second portion comprising a pair of pins which are permanently secured to the first space facing surface of the first portion and which extend below the first portion to engage the floor inside the first space, whereby when the pair of pins are engaged with the floor, the security apparatus blocks the door from opening into the first space; and, further comprising an attachment assembly, the attachment assembly configured to be secured to the door and to provide a slot between the door and the attachment assembly, the first portion of the security apparatus configured to be positioned within the slot when the pair of pins are engaged with the floor, thereby preventing the door from opening into the second space.

13. A method of using a door security system, the method comprising the steps of:

providing a door which separates a first space from a second space;

providing a floor extending into the first and second spaces, the door being positioned over the floor, the door being separated from the floor to define a gap between the door and the floor;

providing a security apparatus comprising a floor engaging portion and a door blocking portion, the security apparatus being provided in the first space adjacent to a first side of the door;

providing a release mechanism configured to be manipulated by a user from the second space and comprising a handle portion and a security apparatus engaging portion, the security apparatus engaging portion being connected to the handle portion;

engaging the floor engaging portion of the security apparatus with the floor provided in the first space, thereby retaining the security apparatus in place relative to the floor, and thereby causing the door blocking portion to block the door from opening into the first space;

moving the security engaging portion of the release mechanism through the gap to provide that at least a portion of the security apparatus engaging portion of the mechanism is positioned in the first space; and manipulating the handle portion of the release mechanism to cause the security apparatus engaging portion of the release mechanism to engage the security apparatus in a manner which causes the floor engaging portion to disengage from the floor in the first space such that the door is no longer blocked from opening into the first space.

14. The method as defined in claim 13, further comprising the steps of:

providing a receiving assembly in the portion of the floor provided in the first space;

engaging the floor engaging portion of the security apparatus with the receiving assembly, thereby retaining the security apparatus in place relative to the floor, and thereby causing the door blocking portion to block the door from opening into the first space.

15. The method as defined in claim 13, further comprising the steps of:

providing an attachment assembly;

securing the attachment assembly to the door to provide a slot between the first side of the door and the attachment assembly; and positioning the security apparatus within the slot, thereby causing the security apparatus and the attachment assembly to block the door from opening into the second space.

16. A method of using a door security system, the method comprising the steps of:

providing a door which separates a first space from a second space;

providing a floor extending into the first and second spaces, the door being positioned over the floor, the floor comprising a pair of holes therein in the first space;

providing a security apparatus of the door security system in the first space, the security apparatus comprising first and second portions, the first portion comprising first and second opposite surfaces, the second portion comprising a pair of pins which are permanently secured to the second surface of the first portion and which extend below the first portion;

positioning the first surface of the first portion of the security apparatus to face the door;

positioning the pair of pins of the security apparatus over the pair of holes provided in the portion of the floor in the first space; and lowering the pair of pins of the security apparatus into the pair of holes provided in the portion of the floor in the first space, thereby engaging the security apparatus with the floor, and thereby allowing for the first portion of the security apparatus to block the door from opening into the first space; and, further comprising the steps of:

providing the first portion with a floor stop member which extends inwardly from the second surface of the first portion, and away from the first surface of the first portion, the floor stop member being positioned between the pair of pins; and wherein the lowering of the pair of pins of the security apparatus into the pair of holes provided in the portion of the floor in the first space further comprises lowering the security apparatus until the floor stop member is prevented from further downward movement relative to the portion of the floor in the first space.

17. The method as defined in claim 16, further comprising the steps of:

providing the security apparatus with a support plate which is secured to the second surface of the first portion and which extends inwardly from the second surface of the first portion, and away from the first surface of the first portion, the support plate being positioned between the pair of pins, the support plate being positioned above the floor stop member such that a channel is defined between the support plate and the floor stop member;

providing a gap between a bottom of the door and the floor;

providing a release mechanism for manipulation by a user, the release mechanism comprising a handle portion and a security apparatus engaging portion; and manipulating the release mechanism from the second space to position the handle portion in the second space and the security apparatus engaging portion in the first space, with the release mechanism spanning the gap between the bottom of the door and the floor;

manipulating the handle portion of the release mechanism to cause the security apparatus engaging portion to be positioned within the channel of the security apparatus; and manipulating the handle portion of the release mechanism to cause the security apparatus engaging portion to engage the security apparatus within the channel to disengage the pair of pins of the security apparatus from the pair of holes in the portion of the floor in the first space such that the door is no longer blocked from opening into the first space.

18. The method as defined in claim 16, further comprising the steps of:

providing a pair of sleeves which each have an aperture provided therethrough;

positioning the pair of sleeves into the pair of holes provided in the portion of the floor in the first space; and wherein the lowering of the pair of pins of the security apparatus into the pair of holes provided in the portion of the floor in the first space further comprises lowering the pair of pins of the security apparatus into the apertures of the pair of sleeves, thereby engaging the security apparatus with the floor, and thereby allowing for the first portion of the security apparatus to block the door from opening into the first space.

19. A method of using a door security system, the method comprising the steps of: providing a door which separates a first space from a second space; providing a floor extending into the first and second spaces, the door being positioned over the floor, the floor comprising a pair of holes therein in the first space; providing a security apparatus of the door security system in the first space, the security apparatus comprising first and second portions, the first portion comprising first and second opposite surfaces, the second portion comprising a pair of pins which are permanently secured to the second surface of the first portion and which extend below the first portion; providing an attachment assembly; securing the attachment assembly to the door to provide a slot between the door and the attachment assembly, the slot being provided in the first space and being positioned above the pair of holes in the portion of the floor in the first space; positioning the first surface of the first portion of the security apparatus to face the door; positioning the security apparatus over the slot; positioning the pair of pins of the security apparatus over the pair of holes provided in the portion of the floor in the first space; and lowering the pair of pins of the security apparatus through the slot and into the pair of holes provided in the portion of the floor in the first space, thereby engaging the security apparatus with the floor and securing the security apparatus within the slot, thereby allowing for the first portion of the security apparatus to block the door from opening into the first space and allowing the attachment assembly of the security apparatus to block the door from opening into the second space.

* * * * *